US011131164B2

(12) United States Patent
Werries et al.

(10) Patent No.: US 11,131,164 B2
(45) Date of Patent: Sep. 28, 2021

(54) APPARATUS, SYSTEMS AND METHODS FOR ACTUATION OF DOWNHOLE TOOLS

(71) Applicant: NCS Multistage Inc., Calgary (CA)

(72) Inventors: Michael Werries, Calgary (CA); Lyle Laun, Calgary (CA); John Ravensbergen, Calgary (CA); Ramin Tajallipour, Calgary (CA); Brock Gillis, Calgary (CA); Roman Vakulin, Calgary (CA)

(73) Assignee: NCS Multistage Inc., Calgary (CA)

( * ) Notice: Subject to any disclaimer, the term of this patent is extended or adjusted under 35 U.S.C. 154(b) by 0 days.

(21) Appl. No.: 16/557,885

(22) Filed: Aug. 30, 2019

(65) Prior Publication Data

US 2020/0190942 A1 Jun. 18, 2020

Related U.S. Application Data

(60) Provisional application No. 62/778,520, filed on Dec. 12, 2018.

(51) Int. Cl.

| | |
|---|---|
| ***E21B 34/14*** | (2006.01) |
| ***E21B 34/06*** | (2006.01) |
| ***E21B 34/08*** | (2006.01) |

(52) U.S. Cl.

CPC ..... *E21B 34/085* (2013.01); *E21B 34/066* (2013.01); *E21B 34/142* (2020.05)

(58) Field of Classification Search

CPC .... E21B 34/142; E21B 34/066; E21B 47/138; E21B 34/085

See application file for complete search history.

(56) References Cited

U.S. PATENT DOCUMENTS

| | | | | |
|---|---|---|---|---|
| 2008/0164063 | A1* | 7/2008 | Grayson | E21B 47/007 175/45 |
| 2010/0219845 | A1* | 9/2010 | Easter | H03K 17/9622 324/678 |
| 2011/0232917 | A1* | 9/2011 | Skinner | E21B 47/13 166/373 |
| 2014/0238666 | A1* | 8/2014 | Walton | E21B 34/06 166/250.01 |

* cited by examiner

*Primary Examiner* — Cathleen R Hutchins

(74) *Attorney, Agent, or Firm* — Ridout and Maybee LLP

(57) ABSTRACT

A flow control apparatus comprising: a housing, a housing passage disposed within the housing, a subterranean formation flow communicator for effecting flow communication between the subterranean formation and the housing passage, a flow control member, displaceable, relative to the subterranean formation flow communicator, for effecting at least opening of the subterranean formation flow communicator There is further provided a first actuation system for actuating displacement of the flow control member relative to the subterranean flow communicator. There is also provided a second actuation system for actuating displacement of the flow control member relative to the subterranean flow communicator. Relative to the central longitudinal axis of the housing passage, the first actuation system is angularly spaced from the second actuation system.

20 Claims, 24 Drawing Sheets

APPARATUS, SYSTEMS AND METHODS FOR ACTUATION OF DOWNHOLE TOOLS

FIELD

The present disclosure relates to actuation of downhole tools.

BACKGROUND

Mechanical actuation of downhole tools, such as valves, can be fairly unreliable, owing to the difficulty in deploying shifting tools on coiled tubing, or relying on conventional ball drop systems, for actuating such valves, especially in deviated wellbores. Wireless actuation of such downhole tools resolves some of the problems associated with mechanical actuation. However, due to the lack of predictability concerning conditions within a downhole environment, transmission of wireless signals can also suffer from reliability issues. With cemented completions, despite best efforts, residual cement may remain within the wellbore and interfere with signal transmission.

SUMMARY

In one aspect, there is provided a flow control apparatus comprising:

a downhole tool;

an actuation system;

a first sensor disposed for sensing a wirelessly transmitted signal, and coupled to the actuation system such that, in response to the sensing of the transmitted signal by the first sensor, the actuation system actuates operation of the downhole tool; and a second sensor disposed for sensing a wirelessly transmitted signal, and coupled to the actuation system such that, in response to the sensing of the transmitted signal by the second sensor, the actuation system actuates operation of the downhole tool;

wherein, relative to the central longitudinal axis of the housing passage, the first sensor is angularly spaced from the second sensor.

In another aspect, there is provided an apparatus, cemented within a wellbore, comprising:

a downhole tool;

a first actuation system;

a second actuation system;

wherein:

each one of the first and second actuation systems, independently, is responsive to a predetermined actuating stimulus;

the downhole tool and the first actuation system are co-operatively configured such that, in response to application of the actuating stimulus to the first actuation system, operation of the downhole tool is effected;

the downhole tool and the second actuation system are co-operatively configured such that, in response to application of the predetermined actuating stimulus to the second actuation system, operation of the downhole tool is effected; and relative to the central longitudinal axis of the apparatus, the first actuation system is angularly spaced from the second actuation system.

In another aspect, there is provided a flow control apparatus comprising:

a housing;

a housing passage disposed within the housing;

a flow communicator for effecting flow communication between the subterranean formation and the housing passage;

a flow controller;

a first sensor disposed for sensing a wirelessly transmitted signal;

a first actuation system including;

a first fluid-communicating passage disposed for establishing fluid communication between the housing passage and the flow controller, for actuating a change in condition of the flow controller;

a first sealed interface disposed within the first fluid-communicating passage; and a first sealed interface defeater configured for defeating the first sealed interface;

wherein the first sealed interface, the first sealed interface stimulator, and the first sensor are co-operatively configured such that, in response to the receiving of the signal by the first sensor, the first sealed interface defeater effects defeating of the first sealed interface;

a second sensor for sensing a wirelessly transmitted signal; and a second actuation system including:

a second fluid-communicating passage disposed for establishing fluid communication between an actuating fluid supply conductor and the flow controller, for actuating a change in condition of the flow controller;

a second sealed interface disposed within the second fluid-communicating passage; and a second sealed interface defeater configured for defeating the first sealed interface;

wherein the second sealed interface, the second sealed interface stimulator, and the second sensor are co-operatively configured such that, in response to the receiving of the signal by the second sensor, the second sealed interface defeater effects defeating of the second sealed interface;

wherein:

the flow communicator and the flow controller are co-operatively configured for disposition in a closed configuration, wherein, in the closed configuration, the flow communicator is disposed in a closed condition;

the change in condition of the flow controller, which is actuatable in response to fluid communication that is establishable between the housing passage and the flow controller, via the first fluid-communicating passage, in response to the defeating of the first sealed interface, is with effect that the flow controller becomes disposed in the open condition;

the change in condition of the flow controller, which is actuatable in response to fluid communication that is establishable between the housing passage and the flow controller, via the second fluid-communicating passage, in response to the defeating of the second sealed interface, is with effect that the flow controller becomes disposed in the open condition; and relative to the central longitudinal axis of the apparatus, the first actuation system is angularly spaced from the second actuation system.

In another aspect, there is provided an apparatus comprising:

a housing;

a housing passage disposed within the housing;

a controller;

a first signal sensor for measuring a wirelessly transmitted signal; and a second signal sensor for measuring a wirelessly transmitted signal;

wherein:

the controller is configured to determine whether the first signal sensor and second signal sensor are operating normally; and for each one of the first and second signal sensors, independently, the determination includes comparing the signal measured by the signal sensor to one or more performance criteria.

In another aspect, there is provided an apparatus for disposition within a wellbore comprising:

a housing;

a controller;

an actuation system disposed within the housing comprising at least a first actuation subsystem and a second actuation subsystem;

a first orientation sensor positioned within the housing and aligned with the first actuation subsystem, and configured to determine a orientation of the first actuation subsystem; and a second orientation sensor positioned within the housing and aligned with the second actuation subsystem, and configured to determine a orientation of the second actuation subsystem;

wherein the controller is configured to determine which of the first actuation subsystem or second actuation subsystem is in a more desirable orientation by comparing an orientation of each of the first actuation subsystem and second actuation subsystem to one or more reference positions.

In another aspect, there is provided a method of actuating a downhole tool disposed within a wellbore extending through a subterranean formation, comprising:

determining performance of a first sensor disposed within the wellbore;

determining performance of a second sensor disposed within the wellbore; and for each one of the performance determinations, comparing the determined performance to performance criteria.

In another aspect there is provided a method of actuating a downhole tool disposed within a wellbore extending through a subterranean formation, comprising:

determining orientation of a first actuation system disposed within the wellbore;

determining orientation of a second actuation system disposed within the wellbore; and for each one of the determined orientations, independently, comparing the determined orientation to one or more reference positions.

BRIEF DESCRIPTION OF DRAWINGS

The preferred embodiments will now be described with the following accompanying drawings, in which.

DETAILED DESCRIPTION

The present disclosure provides systems, devices and methods that can be use in well completion that provide at least one redundant actuation subsystem that can be used when residual cement (such as, for example, cement stringers), or other particulate matter, prevent actuation of a downhole tool, such as, for example, a flow control apparatus (e.g., valve). Particulate matter can prevent such actuation by blocking flow communication, interfering with sensors, or both. This problem is, generally, confined to the toe stage or the first few stages of a casing string. Reliability of actuation of downhole tools that are disposed further uphole, is, generally, not at risk from such particulate subject matter, as hydraulic fracturing, of stages that are disposed further downhole, typically removes such particulate matter. The provision of a redundant actuation subsystem by the present disclosure at least partially mitigates against the risk that operation of an actuation subsystem may be compromised by residual cement. The redundancy increases the likelihood that operation of at least one of the actuation subsystems is not compromised by residual cement.

Figure 1:
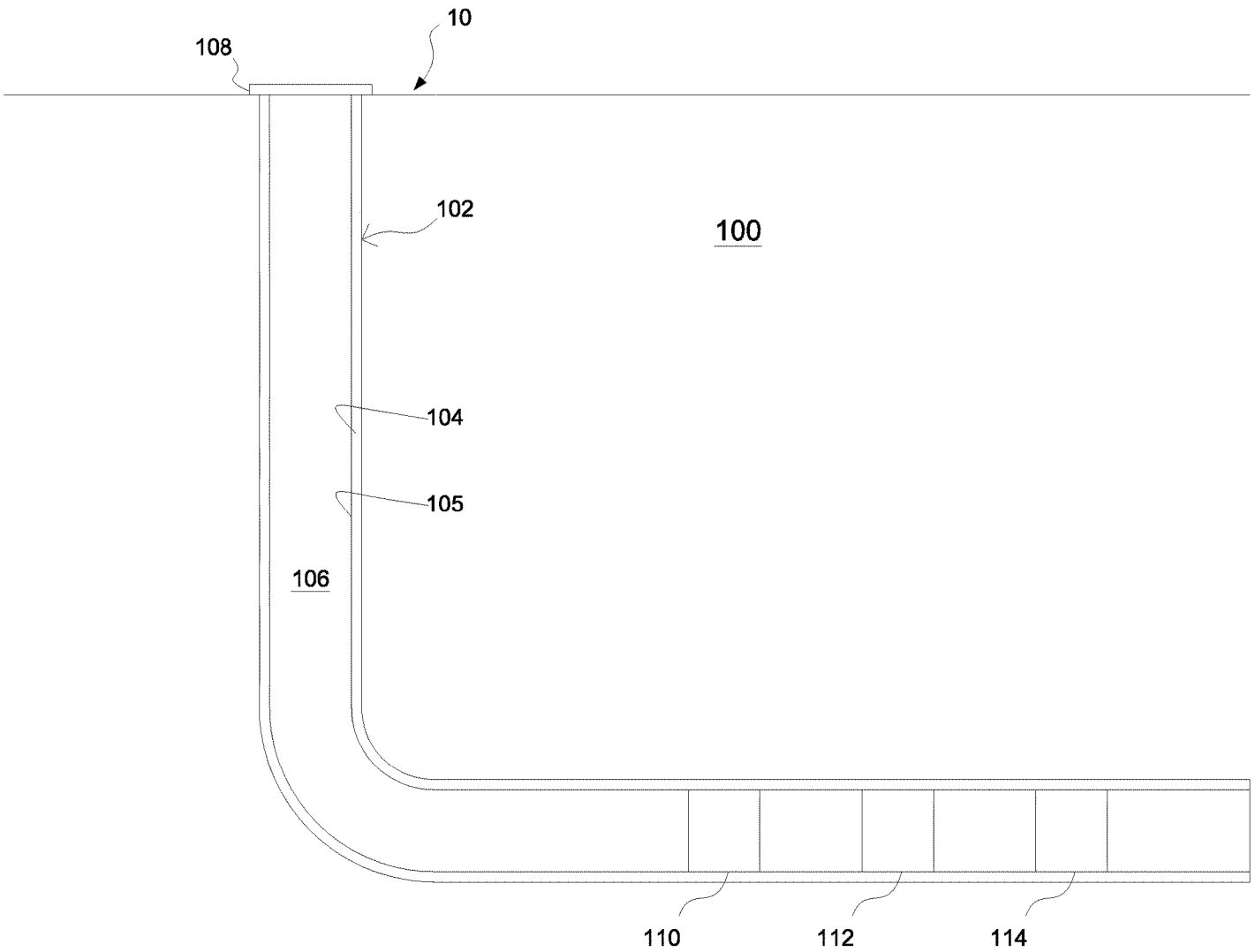
FIG. 1 is a schematic illustration of a system for effecting fluid communication between the surface and a subterranean formation via a wellbore.
Figure 2:
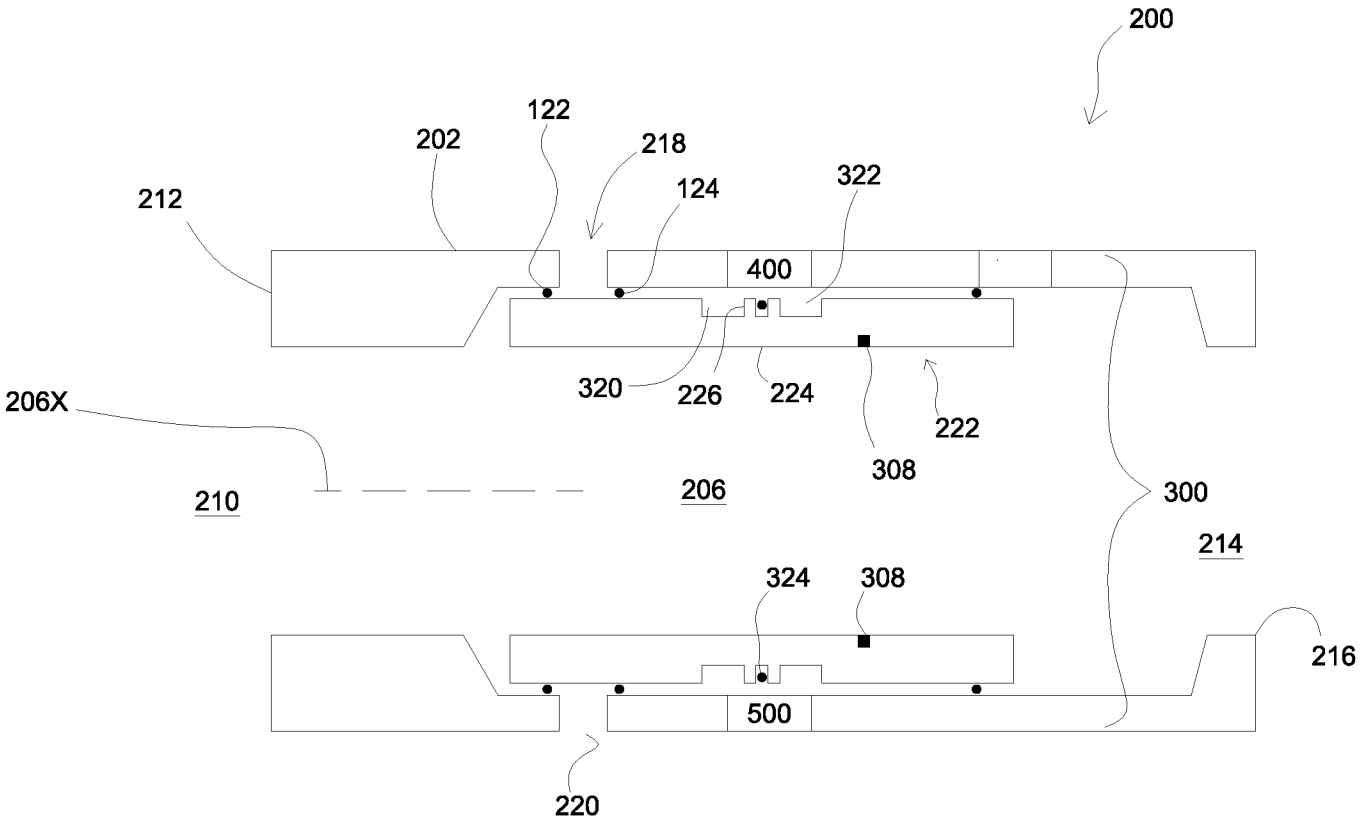
FIG. 2 is a side sectional view of an embodiment of a flow control apparatus for use in the system illustrated in FIG. 1, illustrating the subterranean flow communicator in the closed condition.
Figure 3:
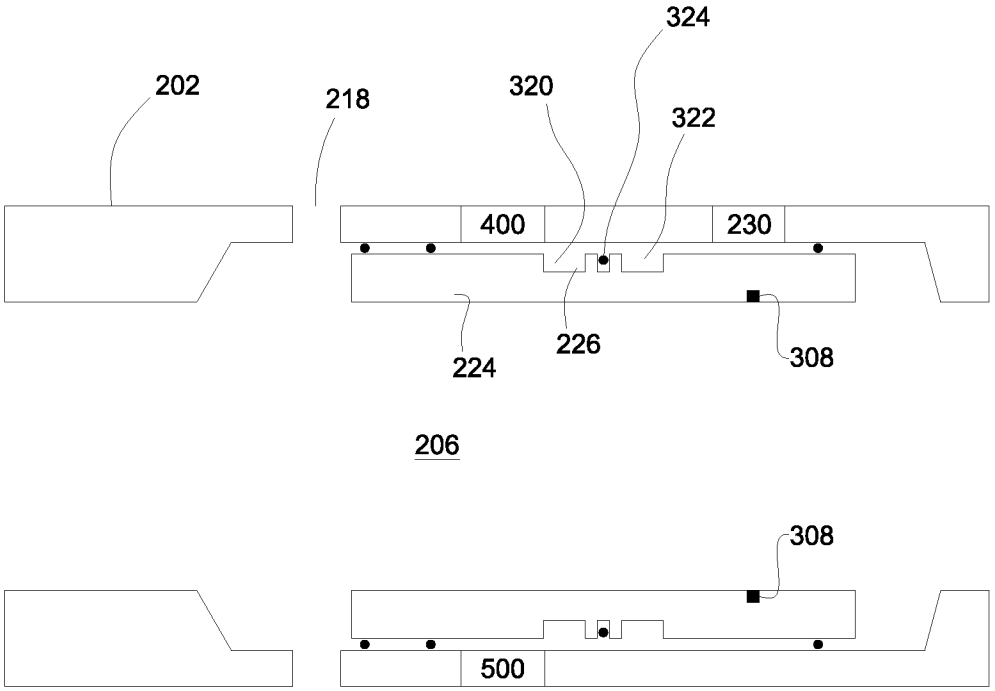
FIG. 3 is a side sectional view of the flow control apparatus illustrated in FIG. 2, illustrating the subterranean flow communicator in the open condition.

Referring to FIG. 1, there is provided a wellbore material transfer system 10 for conducting material from the surface 10 to a subterranean formation 100 via a wellbore 102, from the subterranean formation 100 to the surface 10 via the wellbore 102, or between the surface 10 and the subterranean formation 100 via the wellbore 102. In some embodiments, for example, the subterranean formation 100 is a hydrocarbon material-containing reservoir.

The wellbore 102 can be straight, curved, or branched. The wellbore 102 can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

The wellbore 102 is provided for conducting reservoir fluid from the subterranean formation 100 to the surface 10. In some embodiments, for example, the wellbore 102 is provided for conducting treatment material from the surface 10 to the subterranean formation 100 for stimulating the subterranean formation 100 for production of the reservoir fluid.

In some embodiments, for example, the conducting (such as, for example, by flowing) treatment material to the subterranean formation 100 via the wellbore 102 is for effecting selective stimulation of the subterranean formation 100, such as a subterranean formation 100 including a hydrocarbon material-containing reservoir. The stimulation is effected by supplying the treatment material to the subterranean formation 100. In some embodiments, for example, the treatment material includes a liquid, such as a liquid including water. In some embodiments, for example, the liquid includes water and chemical additives. In other embodiments, for example, the stimulation material is a slurry including water and solid particulate matter, such as proppant. In some embodiments, for example the treatment material includes chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir.

In some embodiments, for example, the conducting of fluid, to and from the wellhead, is effected via a wellbore string 104. The wellbore string 104 may include pipe, casing, or liner, and may also include various forms of tubular segments. The wellbore string 104 defines a wellbore string passage 106 for effecting conduction of fluids between the surface 10 and the subterranean formation 100.

In some embodiments, for example, the wellbore 102 includes a cased-hole completion, in which case, the wellbore string 104 includes a casing 105.

A cased-hole completion involves running casing down into the wellbore 102 through the production zone. The casing 105 at least contributes to the stabilization of the subterranean formation 100 after the wellbore 102 has been completed, by at least contributing to the prevention of the collapse of the subterranean formation 100 that is defining the wellbore 102. In some embodiments, for example, the casing 105 includes one or more successively deployed concentric casing strings, each one of which is positioned within the wellbore 102, having one end extending from the well head 108. In this respect, the casing strings are typically run back up to the surface.

In some embodiments, for example, each casing string includes a plurality of jointed segments of pipe. The jointed segments of pipe typically have threaded connections.

The annular region between the deployed casing 105 and the subterranean formation 100 may be filled with zonal isolation material for effecting zonal isolation. The zonal isolation material is disposed between the casing 105 and the subterranean formation 100 for the purpose of effecting isolation, or substantial isolation, of one or more zones of the subterranean formation from fluids disposed in another zone of the subterranean formation. Such fluids include formation fluid being produced from another zone of the subterranean formation 100 (in some embodiments, for example, such formation fluid being flowed through a production string disposed within and extending through the casing 105 to the surface), or injected stimulation material. In this respect, in some embodiments, for example, the zonal isolation material is provided for effecting sealing, or substantial sealing, of flow communication between one or more zones of the subterranean formation and one or more other zones of the subterranean formation via space between the casing 105 and the subterranean formation 100. By effecting the sealing, or substantial sealing, of such flow communication, isolation, or substantial isolation, of one or more zones of the subterranean formation 100, from another subterranean zone (such as a producing formation), via space between the casing 105 and the subterranean formation 100, is achieved. Such isolation or substantial isolation is desirable, for example, for mitigating contamination of a water table within the subterranean formation by the formation fluids (e.g. oil, gas, salt water, or combinations thereof) being produced, or the above-described injected fluids.

In some embodiments, for example, the zonal isolation material is disposed as a sheath within an annular region between the casing 105 and the subterranean formation 100. In some embodiments, for example, the zonal isolation material is bonded to both of the casing 105 and the subterranean formation 100. In some embodiments, for example, the zonal isolation material also provides one or more of the following functions: (a) strengthens and reinforces the structural integrity of the wellbore, (b) prevents, or substantially prevents, produced formation fluids of one zone from being diluted by water from other zones. (c) mitigates corrosion of the casing 105, and (d) at least contributes to the support of the casing 105. The zonal isolation material is introduced to an annular region between the casing 105 and the subterranean formation 100 after the subject casing 105 has been run into the wellbore 102. In some embodiments, for example, the zonal isolation material includes cement.

Zonal isolation material is typically emplaced within the annular region by pumping the zonal isolation material, downhole, through the casing 105, such that it is discharged from the casing at the bottom of the wellbore, and is then urged to fill the annular space between the casing 105 and the subterranean formation 100. After this operation, steps are taken to remove residual zonal isolation material that remains within the casing 105, such as with wiper plugs. As is further discussed below, despite best efforts, residual zonal isolation material may persist and, potentially, affect subsequent stimulation and production processes.

Conducting of treatment material from the surface 10 to the subterranean formation 100 to stimulate production, and, separately, conducting of produced hydrocarbons from the subterranean formation 100 to the surface 10, is effected through the passage 106 of the wellbore string 104 and via one or more flow communication stations (three flow communication stations 110, 112, 114 are illustrated) that are disposed at the interface between the subterranean formation 100 and the wellbore 102. Successive flow communication stations 110, 112, 114 may be spaced from each other along the wellbore 102 such that each one of the flow communication stations 110, 112, 114, independently, is positioned adjacent a zone or interval of the subterranean formation 100 for effecting flow communication between the wellbore 102 and the zone (or interval).

For effecting the flow communication, each one of the flow communication stations 110, 112, 114, independently, includes a flow control apparatus 200. Referring to FIGS. 2 to 7, the flow control apparatus 200 includes a housing 202. The housing 202 includes a housing passage 206. In some embodiments, for example, the housing 202 includes an uphole port 210 at an uphole end 212 of the apparatus 200, and a downhole port 214 at a downhole end 216 of the apparatus 200, and the housing passage 206 extends between the uphole and downhole flow ports 210, 214. The flow control apparatus 200 is configured for integration within the wellbore string 104 such that the wellbore string passage 106 includes the passage 206. The integration may be effected, for example, by way of threading or welding. In some embodiments, for example, the integration is by threaded coupling, and, in this respect, in some embodiments, for example, each one of the uphole and downhole ends 212, 216, independently, is configured for such threaded coupling to other portions of the wellbore string 104. In some embodiments, for example, the flow control apparatus 200 is a wellbore sub. In some embodiments, for example, the components of the flow control apparatus 200 are distributed over two or more wellbore subs. In some embodiments, for example, the flow control apparatus 200 is integrated within the wellbore string, and the integration is with effect that a toe sleeve is defined.

The flow control apparatus 200 includes a valve 201 for selectively effecting flow communication between the housing passage 206 and the subterranean formation 100 while the apparatus is integrated within the wellbore string 104. The valve 201 includes a subterranean formation flow communicator 218 and a flow controller 224.

The flow communicator 218 extends through the housing 202. The housing, the flow communicator 218, and the housing passage 206 are co-operatively disposed such that flow communication is effectible, via the flow communicator 218, between the housing passage 206 and the subterranean formation that is external to the flow control apparatus 200. In some embodiments, for example, the subterranean formation flow communicator 218 is in the form of one or more ports 220 defined within the housing 202.

The flow controller 222 is configured for controlling flow of material, via the flow communicator 218, between the passage 206 and an environment external to the flow control apparatus 200. In this respect, the flow controller 222 is configured for controlling the material flow through the flow communicator 218.

The flow controller 222 is configured for opening a closed flow communicator 218. In some embodiments, for example, the opening of the flow communicator 218 effects a reduction in the portion of the flow communicator 218 being occluded by the flow controller 222.

In some embodiments, for example, the flow controller 222 is configured for closing a fully opened, or partially opened, flow communicator 218. In some of these embodiments, for example, the closing of the flow communicator 218 effects an increase in the portion of the flow communicator 218 being occluded by the flow controller 222.

The flow communicator 218 is configured for disposition in a closed condition and an open condition.

In some embodiments, for example, while the flow communicator 218 is disposed in the closed condition, the flow controller 222 and the flow communicator 218 are co-operatively disposed in a closed configuration, and, in the closed configuration, the flow controller 222 is occluding the flow communicator 218. In some embodiments, for example, in the closed configuration, the flow controller 222 and the flow communicator 218 are co-operatively disposed such that flow communication, between the wellbore string passage 106 and the subterranean formation, is sealed or substantially sealed. In this respect, conduction of material between the wellbore string 104 and the subterranean formation 100, via the flow communication station (110, 112, or 114) is prevented, or substantially prevented.

In some embodiments, for example, while the flow communicator 218 is disposed in the open condition, the flow controller 224 and the flow communicator 218 are co-operatively disposed in an open configuration, and, in the open configuration, less than the entirety of the flow communicator 218 is occluded by the flow controller 222. In some of these embodiments, for example, a portion of the flow communicator 218 is occluded by the flow controller 222, and there is an absence of occlusion of at least another portion of the flow communicator 218 by the flow controller 222, such that the flow communicator 218 is disposed in a partially opened condition. In other ones of these embodiments, for example, there is an absence occlusion of any portion, or substantially any portion, of the flow communicator 218 by the flow controller 222, such that the flow communicator 218 is disposed in the fully opened condition.

In this respect, the open condition includes both of the partially opened condition and the fully opened condition.

In some embodiments, for example, while the flow communicator 218 is disposed in the open condition, fluid material (e.g. liquid material) is conductible from the wellbore string 104 to the subterranean formation via the opened flow communicator 218. In some embodiments, for example, the fluid material is conducted through the opened flow communicator over a time interval of at least 20 minutes, such as, for example, at least one hour, such as, for example, at least 12 hours, such as, for example, at least 24 hours. In some embodiments, for example, the fluid material includes fluid being conducted through the wellbore string 104 for conveying (e.g. "pumping down") a tool within the wellbore string 104 in a downhole direction. In other embodiments, for example, the fluid material includes treatment material that is injected from the surface for stimulating production of hydrocarbon material from the subterranean formation 100.

In some embodiments, for example, after completion of the injection of fluid into the subterranean formation 100 via the opened flow communicator 218, closing of the flow communicator 218 is effected. In some of these embodiments, for example, the flow communicator 218 becomes disposed in the closed condition.

The flow control apparatus 200 further includes an actuation system 300 for actuating a change in the co-operative disposition between the flow controller 222 and the flow communicator 218, with effect that there is a change in the condition of the flow communicator 218 from the closed condition to the open condition.

In some embodiments, for example, the actuation system 300 is configured to effect the change in the co-operative disposition between the flow controller 222 and the flow communicator 218 in response to application of fluid pressure via the wellbore 102. In this respect, the apparatus 200 further includes a frangible member, such as, for example, a rupture disc that is configured to fracture in response to receiving application of a minimum predetermined fluid pressure.

In some embodiments, for example, the actuation system 300 is configured to effect the change in the co-operative disposition between the flow controller 222 and the flow communicator 218 in response to a signal that is transmitted from the surface 10 to a space that is disposed below the surface 10, and, in this respect, the apparatus 200 further includes a signal sensor configuration 308 for sensing the transmitted signal. In some embodiments, for example, the transmitted signal includes a wirelessly transmitted signal.

In some embodiments, for example, the wirelessly transmitted signal is a signal transmitted from the surface 10 via fluid within the wellbore string passage 106, such as, for example, a pressure signal.

In some embodiments, for example, the wirelessly transmitted signal is a seismic signal that is generated by a seismic source. The seismic signal can be transmitted within the wellbore string passage 106, or outside of the wellbore string passage 106, and the signal sensor configuration 308 is configured to receive the transmitted seismic signal. In some embodiments, for example, the seismic source includes a seismic vibrator unit. In some of these embodiments, for example, the seismic vibration unit is disposed at the surface 10.

Also, in some embodiments, for example, the actuation system 300 is configured for establishing fluid communication between fluid within the wellbore 102 (such as, for example, the wellbore string passage 106) and the valve 201, such that the change in the co-operative disposition between the flow controller 222 and the flow communicator 218 is effected. In this respect, the change in the co-operative disposition between the flow controller 222 and the flow communicator 218 is effected in response to the establishing of the fluid communication.

In some embodiments, for example, the actuation system 300 incorporates both concepts, such that the fluid communication, established between fluid within the wellbore string passage 106 and the valve 201, is stimulated in response to a signal, that is transmitted from the surface 10, and which is sensed downhole by the signal sensor configuration 308.

In every one of these cases, reliable actuation depends on one or both of: (i) reliable sensing of the transmitted signal, and (ii) reliable communication of fluid between the wellbore string passage 106 and the valve 201. Reliability of each one of these two operations may be compromised by the presence of debris within the wellbore 102 (such as, for example, the wellbore string passage 106), such as residual cement (e.g. cement stringers) which may remain after a cementing operation despite best efforts to remove such residual cement, such as, for example, with wiper plugs.

Referring to FIGS. 2 to 10, to mitigate against the above-described operational risks, in some embodiments, for example, the flow controller 222 is of a configuration such that the flow controller 222 includes a flow control member 224, and the actuation system 300 includes two actuation subsystems 400, 500. Each one of the two actuation subsystems, independently, is configured for actuating displacement of the flow control member 224, with effect that there is a change in the condition of the flow communicator 218 from the closed condition to the open condition.

The change in condition of the flow communicator 218, from the closed condition to the open condition, is effected by displacement of the flow control member 224 relative to the flow communicator 218. The flow control member 224 is displaceable, relative to the flow communicator 218, from a closed position to an open position. The closed position of the flow control member 224 corresponds to the closed condition of the flow communicator 218, and the open position of the flow control member 224 corresponds to the open condition of the flow communicator 218. Displacement of the flow control member 224, relative to the flow communicator 218, from the closed position to the open position, effects flow communication, via the flow communicator 218, between the wellbore string 104 and the subterranean formation 100, such that the conducting of material between the wellbore string 104 and the subterranean formation 100, via the flow communication station, is enabled.

In some embodiments, for example, the flow control member 224 is a sliding sleeve that is slideably disposed within the housing passage 206.

In some embodiments, for example, while the flow control member 224 is disposed in the closed position, the flow control member 224 is disposed, relative to the flow communicator 218, such that a sealed interface is disposed between the wellbore string passage 106 and the subterranean formation 100, and the disposition of the sealed interface is such that the conduction of material between the wellbore string 104 and the subterranean formation 100, via the flow communication station (110, 112, or 114) is prevented, or substantially prevented. In some embodiments, for example, the sealed interface is established by sealing engagement, or substantially sealing engagement, between the flow control member 224 and the housing 202. In this respect, in some embodiments, for example, the housing 202 includes one or more sealing surfaces configured for sealing engagement with the flow control member 224, wherein the sealing engagement defines the sealed interface. In this respect, sealing surfaces 122, 124 are defined on an internal surface of the housing 202 for sealing engagement with the flow control member 224. In some embodiments, for example, each one of the sealing surfaces 122, 124 is defined by a respective sealing member. In some embodiments, for example, each one of the sealing members, independently, includes an o-ring. In some embodiments, for example, the o-ring is housed within a recess formed within the housing 202. In some embodiments, for example, the sealing member includes a molded sealing member (i.e. a sealing member that is fitted within, and/or bonded to, a groove formed within the sub that receives the sealing member). In some embodiments, for example, the flow communicator 218 extends through the housing 202, and is disposed between the sealing surfaces 122, 124. In those embodiments where, in the closed position, the flow control member 224 is disposed in sealing engagement, or substantially sealing engagement, with the housing 202 (such that the sealed interface is established), displacement of the flow control member 224 to the open position effects defeating of the sealed interface. In some of these embodiments, for example, the defeating of the sealed interface results in the flow control member 224 becoming spaced apart, or retracted, from the sealing surfaces 122, 124.

In some embodiments, for example, while the flow control apparatus 200 is being run-in-hole, the flow control member 224 is releasably retained relative to the housing 202 by one or more frangible interlocking members (not shown), such as, for example, one or more shear pins. In some of these embodiments, for example, while releasably secured relative to the housing 202, the flow control member 224 is disposed relative to the flow communicator 218 such that the flow communicator 218 is disposed in the closed condition (see FIG. 2). In such embodiments, release of the flow control member 224 from the releasable retention relative to the housing 202 by the one or more frangible interlocking members, is effectible in response to a force applied to the flow control member 224 in a direction that is parallel, or substantially parallel, to the central longitudinal axis of the housing passage 206. In some embodiments, for example, the applied force is in the uphole direction. In some embodiments, for example, the applied force is in the downhole direction. The applied force functions to mechanically fracture the one or more frangible interlocking members, and thereby effect the release.

Upon such release, the flow control member 224 becomes displaceable relative to the flow communicator 218, for effecting opening of the flow communicator 218. In this respect, while the flow control member 224 is released from retention relative to the housing, in response to a force applied to the flow control member 224 in a direction that is parallel, or substantially parallel, to the central longitudinal axis of the housing passage 206, the flow control member 224 is displaced, relative to the flow communicator 218, for effecting opening of the flow communicator 218, such that the flow communicator 218 becomes disposed in the fully opened condition (see FIG. 3). In some embodiments, for example, the applied force is in an uphole direction, such that displacement (an "opening displacement") of the flow control member 224, for effecting the opening of the flow communicator 218, is in the uphole direction. In other embodiments, for example, the applied force is in the downhole direction, such that displacement of the flow control member 224, for effecting the opening of the flow communicator 218, is in the downhole direction.

Each one of the at least two actuation subsystems 400, 500, independently, is configured to actuate the displacement of the flow control member 224 from the closed position to the open position. In those embodiments where the flow control member 224 is releasably retained relative to the housing 202 by one or more frangible interlocking members while the flow control apparatus 200 is being run-in-hole, in some of these embodiments, for example, each one of the at least two actuation subsystems 400, 500, independently, is configured to, in sequence, actuate the release of the flow control member 224 from the retention relative to the housing 202, and upon the release of the flow control member 224 from the retention relative to the housing, actuate the displacement of the flow control member 224 from the closed position to the open position.

The actuation system 300 is provided with at least two actuation subsystems 400, 500, such that redundancy is built into the actuation system 300 for effecting the displacement of the flow control member 224 from the closed position to the open position (and, in some embodiments, for example, effecting the release of the retention of the flow control member 224 relative to the housing 202). In this respect, in case the reliability of one of the actuation subsystems 400, 500, for actuating displacement of the flow control member 224, is compromised, the other one of the actuation subsystems 400, 500 is available to effect the desired actuation. Although two actuation subsystems 400, 500 are illustrated herein, it is understood that more than two actuation subsystems may be provided in other embodiments.

Figure 4:
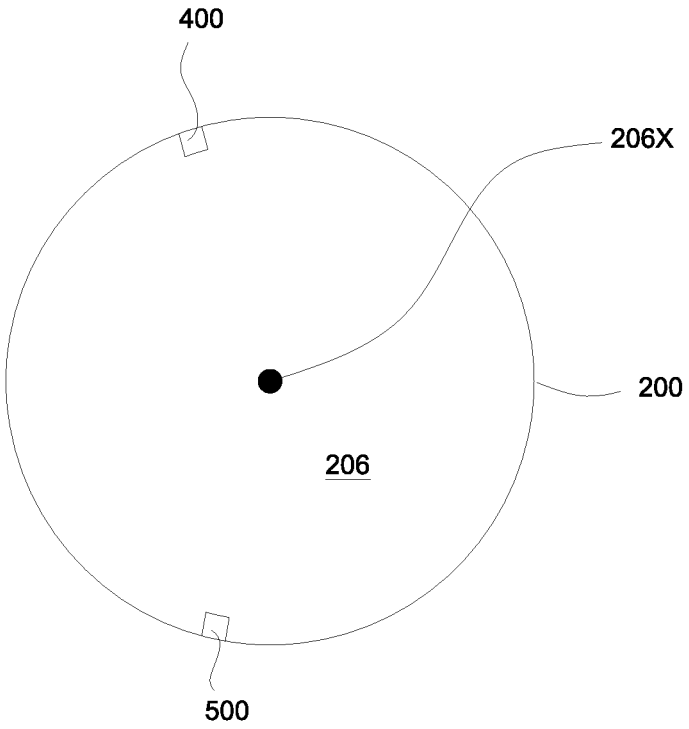
FIG. 4 is a schematic illustration of a section of the flow control apparatus in FIGS. 2 and 3, illustrating the relative positioning of the actuation subsystems.

Referring to FIG. 4, in some embodiments, for example, relative to the central longitudinal axis 206X of the housing passage 206, one of the actuation subsystems 400, 500 is angularly spaced from the other one of the actuation subsystems 400, 500, such as, for example, by an angle of between about 45 degrees and about 315 degrees, such as, for example, between about 90 degrees and about 270 degrees, such as, for example, between about 135 degrees and about 225 degrees, such as, for example, between about 165 degrees and 195 degrees. In some embodiments, for example, the angular spacing is about 180 degrees. In this respect, in some embodiments, the above-described operational risks are more pronounced when an actuation system is disposed closer to the lowermost point within the wellbore string 104, and, in the event that one of the actuation subsystems 400, 500 (the potentially compromised actuation system) is disposed in proximity to the lowermost point within the wellbore string 104, it is desirable that the other one of the actuation subsystems 400, 500 is not also disposed in proximity to the lowermost point within the wellbore string 104, and, hence, is angularly spaced from the potentially compromised actuation system.

In some embodiments, for example, the actuating subsystems 400, 500 are aligned, or substantially aligned, with each other. In other embodiments, for example, the actuating subsystems 400, 500 are axially spaced apart from one another.

In some embodiments, for example, each one of the actuation subsystems 400, 500, independently, is configured to effect the displacement of the flow control member 224 relative to the flow communicator 218 in response to the above-described transmitted signal. In this respect, in some embodiments, for example, the signal sensor configuration 308 includes at least two signal sensors 308A, and each one of the actuation subsystems 400, 500, independently, is configured to effect the displacement of the flow control member 224 relative to the flow communicator 218 in response to the sensing of the transmitted signal by a respective one of the signal sensors 308A.

In some embodiments, for example, each one of the signal sensors 308A, independently, is disposed for sensing a wirelessly transmitted signal. As above-described, in some embodiments, for example, the wirelessly transmitted signal is a seismic signal. As well, in some embodiments, for example, the wirelessly transmitted signal is a signal transmitted via fluid within the wellbore string passage 106. In this respect, in some embodiments, for example, each one of the signal sensors 308A, independently, is mounted within the housing 202 and extends into the housing passage 206, such that the signal sensors 308A are disposed within the housing passage 206 for sensing wirelessly transmitted signals that are being transmitted through the housing passage 206.

The sensor 308A of the actuation subsystems 400 may be configured to be actuated by a different wirelessly transmitted actuation signal than the sensor 308A of the actuation subsystem 500, and thereby allow the actuation subsystems 400, 500 to be selectively actuated. If both of the actuation subsystems 400, 500 are to be actuated, the actuation signals for both of the actuation subsystems 400, 500 are transmitted.

In some embodiments, for example, the transmitted actuation signal is a pressure signal, such as one or more pressure pulses. In some embodiments, for example, the transmitted actuation signal is defined by a pressure pulse characterized by at least a magnitude. In some embodiments, for example, the transmitted signal is defined by a pressure pulse characterized by at least a duration. In some embodiments, for example, the transmitted actuation signal is defined by a pressure pulse characterized by a combination of at least a magnitude and a duration. Different pressure pulse signals may be used to actuate the actuation subsystems 400 or 500, respectively.

In some embodiments, for example, the transmitted actuation signal is defined by a plurality of pressure pulses. In some embodiments, for example, the transmitted actuation signal is defined by a plurality of pressure pulses, each one of the pressure pulses characterized by at least a magnitude. In some embodiments, for example, the transmitted actuation signal is defined by a plurality of pressure pulses, each one of the pressure pulses characterized by at least a magnitude and a duration. In some embodiments, for example, the transmitted actuation signal is defined by a plurality of pressure pulses, each one of the pressure pulses characterized by at least a duration. In some embodiments, for example, each one of pressure pulses is characterized by time intervals between the pulses. Different signals comprising a different series of plurality of pressure pulses may be used to actuate the actuation subsystems 400 or 500, respectively.

In some embodiments, for example, the transmitted actuation signal is defined by a pressure and hold signal. A pressure and hold signal is a sustained pressure signal. The pressure and hold signal may be defined by a pressure signal that is sustained for a duration of time, which comprise a number of seconds or a number of minutes, for example. Different pressure and hold signals may be used to actuate the actuation subsystems 400 or 500, respectively. For example, both pressure and hold signals may have the same pressure but a different duration, e.g. one sensor 308A may be configured to actuate one of the actuation subsystems 400 or 500 after a sustained pressure P for a time t, whereas the other sensor 308A may be configured to actuate the other of the actuation subsystems 400 or 500 after a sustained pressure P for a time t+x.

In this respect, in those embodiments where the transmitted signal is a pressure signal being transmitted via fluid within the wellbore string passage 106, in some of these embodiments, for example, each one of the signal sensors 308A, independently, is a pressure sensor. An exemplary pressure sensor is a Kellar Pressure Transducer Model 6LHP/81188TM. Other suitable sensors may be employed, depending on the nature of the signal being used for the actuating signal. Other suitable sensors include a Hall effect sensor, a radio frequency identification ("RFID") sensor, or a sensor that can detect a change in chemistry (such as, for example, pH), or radiation levels, or ultrasonic waves.

Figure 5:
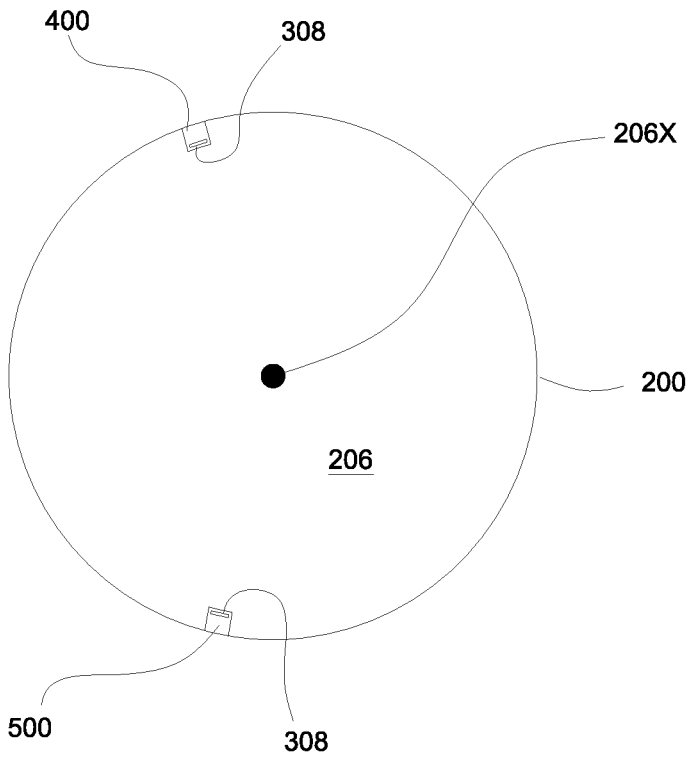
FIG. 5 is a schematic illustration of a section of the flow control apparatus in FIGS. 2 and 3, illustrating the relative positioning of the sensors of the actuation subsystems.

Referring to FIG. 5, for further addressing the reliability of actuation of the displacement of the flow control member 224, in some embodiments, for example, relative to the central longitudinal axis 206X of the housing passage 206, the signal sensor 308A that is respective to the first actuation subsystem 400 is angularly spaced from the signal sensor 308A that is respective to the second actuation subsystem 500. In those embodiments where the signal sensors 308A are extending into the housing passage, by providing this configuration, there is a decreased risk that solid debris (e.g. residual cement), present within the wellbore string passage 106, will interfere with the sensing, by an actuation system 300, of an actuation signal that is being transmitted downhole. In some of these embodiments, for example, the angular spacing between the signal sensor 308A that is respective to the first actuation subsystem 400 and the signal sensor 308A that is respective to the second actuation subsystem 500 is between about 45 degrees and about 315 degrees, such as, for example, between about 90 degrees and about 270 degrees, such as, for example, between about 135 degrees and about 225 degrees, such as, for example, between about 165 degrees and 195 degrees. In some embodiments, for example, the angular spacing is about 180 degrees.

In some embodiments, for example, the signal sensor 308A that is respective to the first actuating subsystem 400 is aligned, or substantially aligned, with the signal sensor 308A that is respective to the second actuating subsystem 500. In other embodiments, for example, the signal sensor 308A that is respective to the first actuating subsystem 400 is axially spaced apart from the signal sensor 308A that is respective to the second actuating subsystem 500.

Referring to FIGS. 6 to 9, in some embodiments, for example, each one of the actuation systems 400, 500, independently, further includes a respective fluid-communicating passage 302 and a respective fluid communication controller. Each one of the fluid communication controllers, independently, includes a respective sealed interface 304 and a respective sealed interface stimulator 306.

In some embodiments, for example, for each one of the actuation subsystems 400, 500, independently, the fluid-communicating passage 302 extends between the housing passage 206 and a fluid pressure responsive surface 226 of the flow control member 224 for effecting fluid communication, between fluid within the housing passage 206 and the fluid pressure responsive surface 226 of the flow control member 224, for urging displacement of the flow control member 224 relative to the subterranean flow communicator 218 (from the closed position to the open position). In some embodiments, for example, the fluid-communicating passage extends through a passage 228 defined within the flow control member 224. In some embodiments, for example, the fluid-communicating passage 302 includes a port 302A that merges with the housing passage 206. The sealed interface 304 is disposed within the fluid-communicating passage 302. In some embodiments, for example, the sealed interface 304 effects sealing, or substantial sealing, of fluid communication between the housing passage 206 and the fluid pressure responsive surface 226 of the flow control member 224. The sealed interface stimulator 306 is configured for effecting stimulation of the sealed interface 304, with effect that the sealed interface 304 becomes disposed in a stimulated condition. The sealed interface 304, the sealed interface stimulator 306, and the signal sensor 308A are co-operatively configured such that, in response to the sensing of the transmitted signal by the signal sensor 308A, the first sealed interface stimulator 306 effects stimulation of the sealed interface 304.

Figure 10:
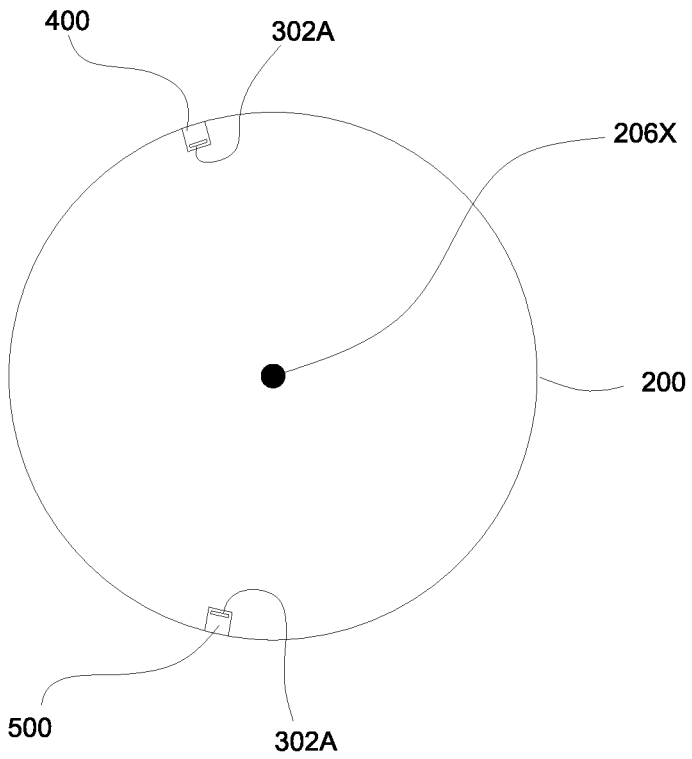
FIG. 10 is a schematic illustration of a section of the flow control apparatus in FIGS. 2 and 3, illustrating the relative positioning of the communication ports of the actuation subsystems.

Referring to FIG. 10, also to further address the reliability of actuation of the flow control member 224, in some embodiments, for example, relative to the central longitudinal axis 206X of the housing passage 206, the communication port 302A of the first actuation system 400 is angularly spaced from the communication port 302A of the second actuation system 500. In some of these embodiments, for example, by providing this configuration, there is a decreased risk that sold debris (e.g. residual cement), present within the wellbore string passage 106, will block fluid communication between the housing passage 206 and the fluid pressure responsive surface 226. In some of these embodiments, for example, the angular spacing between the communication port 302A of the first actuation system 400 and the communication port 302A of the second actuation system 500 is between about 45 degrees and about 315 degrees, such as, for example, between about 90 degrees and about 270 degrees, such as, for example, between about 135 degrees and about 225 degrees, such as, for example, between about 165 degrees and 195 degrees. In some embodiments, for example, the angular spacing is about 180 degrees.

It is, however, understood, that actuation of the flow control member 224 can be effected in response to communication between fluid that is disposed externally of the housing 202 and the fluid pressure responsive surface 226 of the flow control member 224, for urging displacement of the flow control member 224 relative to the subterranean flow communicator 218, and, in this respect, the port 302A can be disposed on an external surface of the housing 202. Also, it is understood that the signal sensor 308 can be disposed for sensing wireless signals being transmitted externally of the housing 202.

Figure 6:
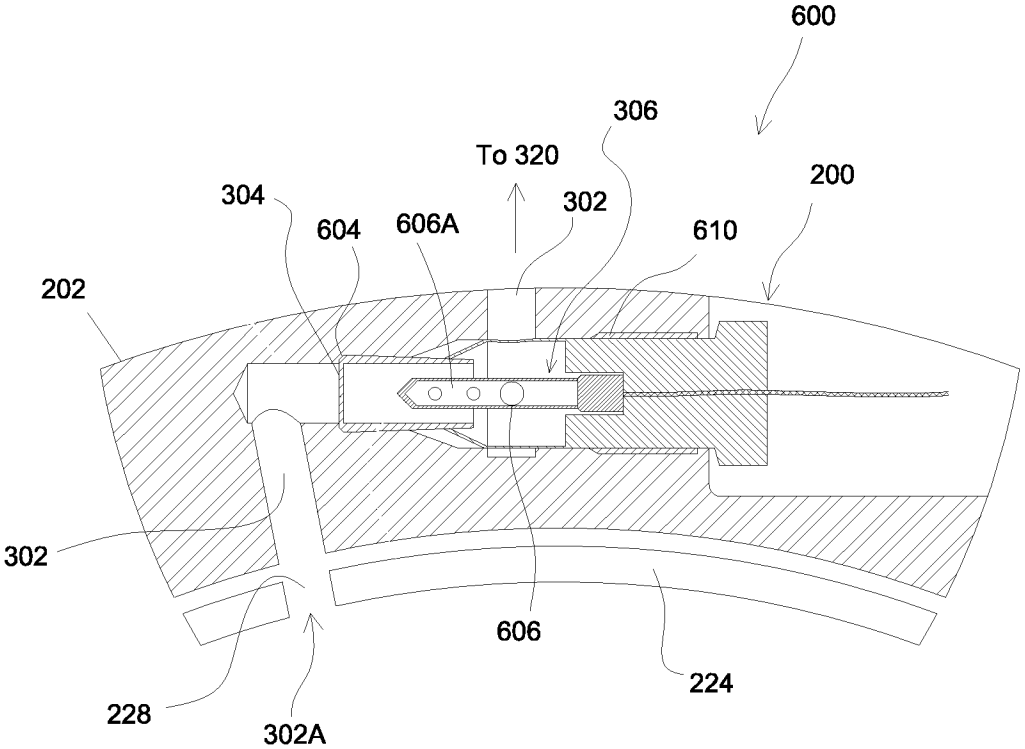
FIG. 6 is a schematic illustration of a fragment of the flow control apparatus illustrated in FIGS. 2 and 3, having a cutter as its sealed interface stimulator, illustrated prior to the puncturing of a rupture disc.
Figure 7:
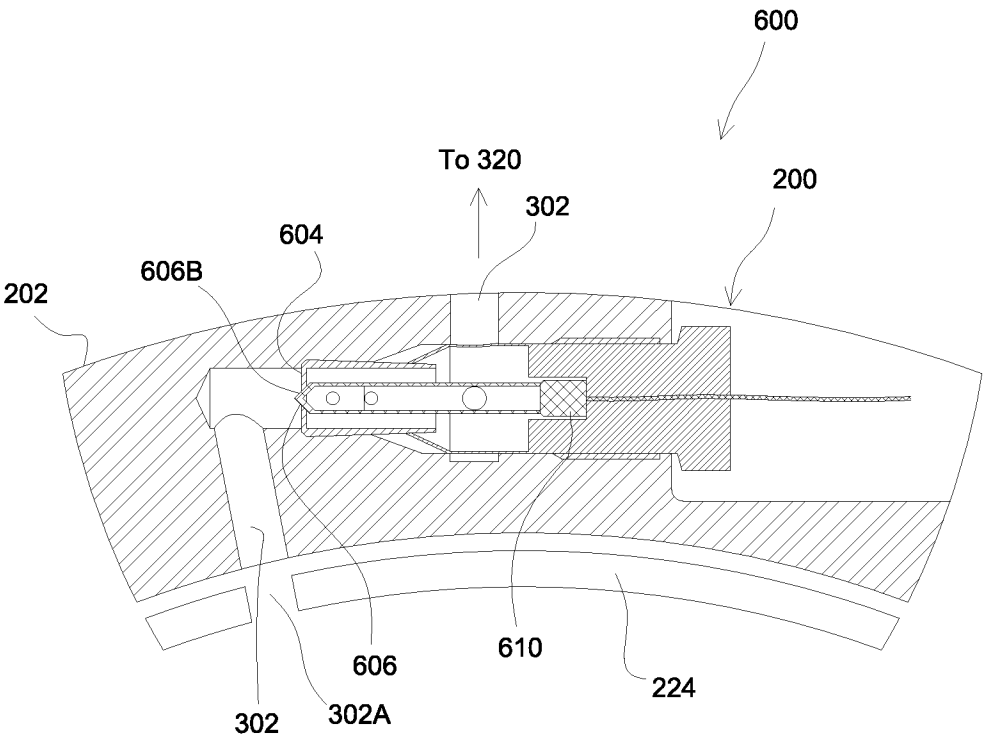
FIG. 7 is a schematic illustration of the fragment shown in FIG. 6, illustrated after the puncturing of a rupture disc by the cutter.

Referring to FIGS. 6 and 7, in some embodiments, for example, each one of the actuation subsystems 400, 500, independently, is in the form of an actuation subsystem 600. With respect to the sealed interface stimulator 306 of the actuation subsystem 600, the sealed interface stimulator 306 is a sealed interface defeater configured for effecting defeating of the sealed interface 304. In this respect, the stimulation, effected by the sealed interface stimulator 306, includes a defeating of the sealed interface 304. So long as the fluid-communicating passage 302 is not blocked by debris (e.g. residual cement), the defeating of the sealed interface 604 is with effect that fluid communication becomes established between the housing passage 206 and the pressure responsive surface 226, and, while the housing passage 206 is disposed in fluid communication with the pressure responsive surface 226 via the fluid-communicating passage 302, fluid, that is communicated, via the fluid-communicating passage, from the housing passage 206 to the pressure responsive surface 226, urges the displacement of the flow control member 224 relative to the flow communicator 218, with effect that the displacement is effected. In some embodiments, for example, the displacement effects an opening of the flow communicator 218. In this respect, in some embodiments, for example, the sealed interface stimulator 306 is in the form of a cutter 606, and the sealed interface 304 is defined by a rupture disc 604. The cutter 606 is configured for puncturing the rupture disc 604 in response to the sensing of an actuating signal by the signal sensor configuration 308. The puncturing of the rupture disc 604 by the cutter 606 is with effect that the sealed interface 304 (defined by the rupture disc 604) is defeated (see FIG. 5). In some embodiments, for example, the cutter 606 includes a bayonet 606A, threaded to the housing 602, and that is actuatable, by an energetic device 610 (such as, for example, a squib), relative to the rupture disc 604, for puncturing the rupture disc. Upon actuation by the energetic device 610, the bayonet 606A punctures the rupture disc 604, such that flow communication is effected between the housing passage 206 and the fluid responsive surface 226 of the flow control member 224 such that displacement of the flow control member 224 relative to the flow communicator 218 from the closed position to the open position is effected.

Figure 8:
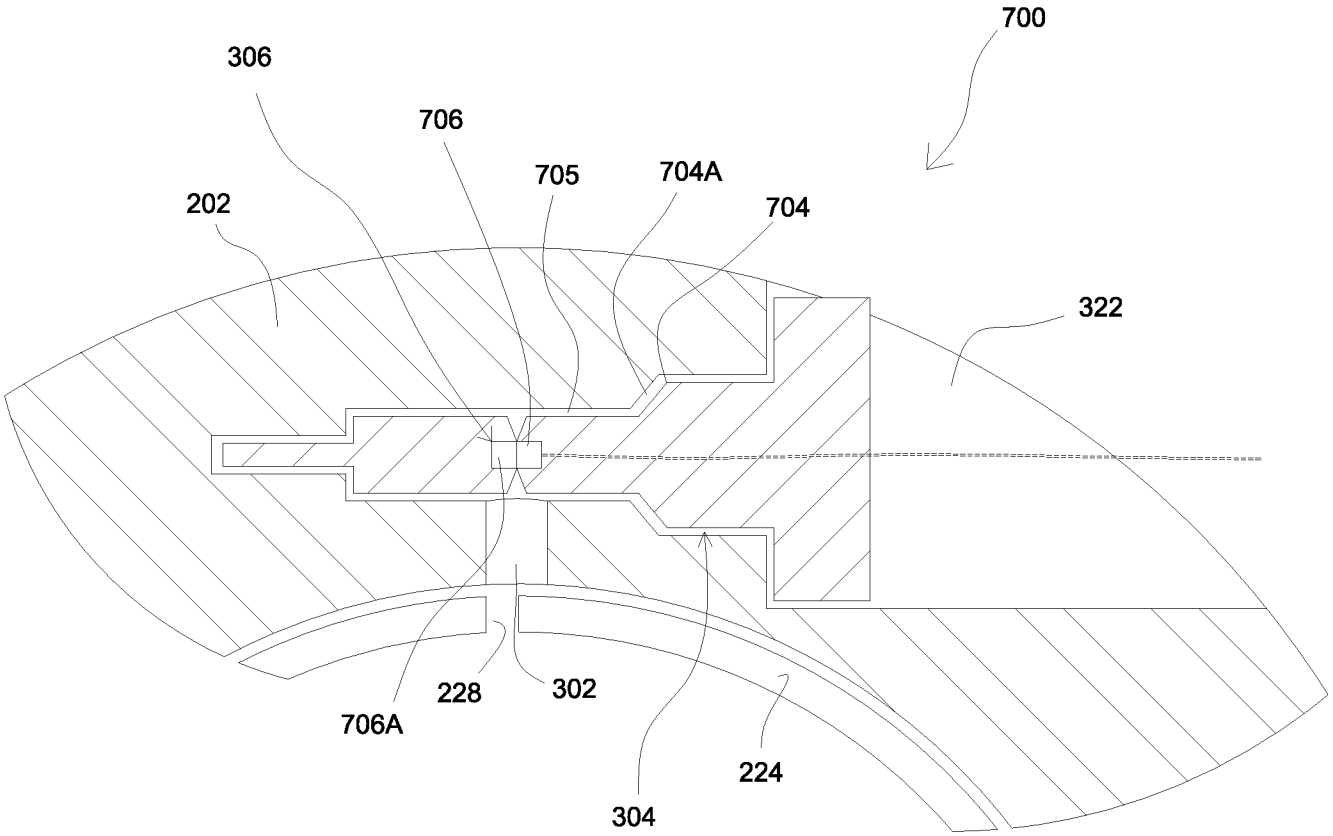
FIG. 8 is a schematic illustration of a fragment of another embodiment of the flow control apparatus illustrated in FIGS. 2 and 3, having an exploding bolt as a combination sealed interface and sealed interface stimulator, illustrated prior to defeating of the sealed interface.
Figure 9:
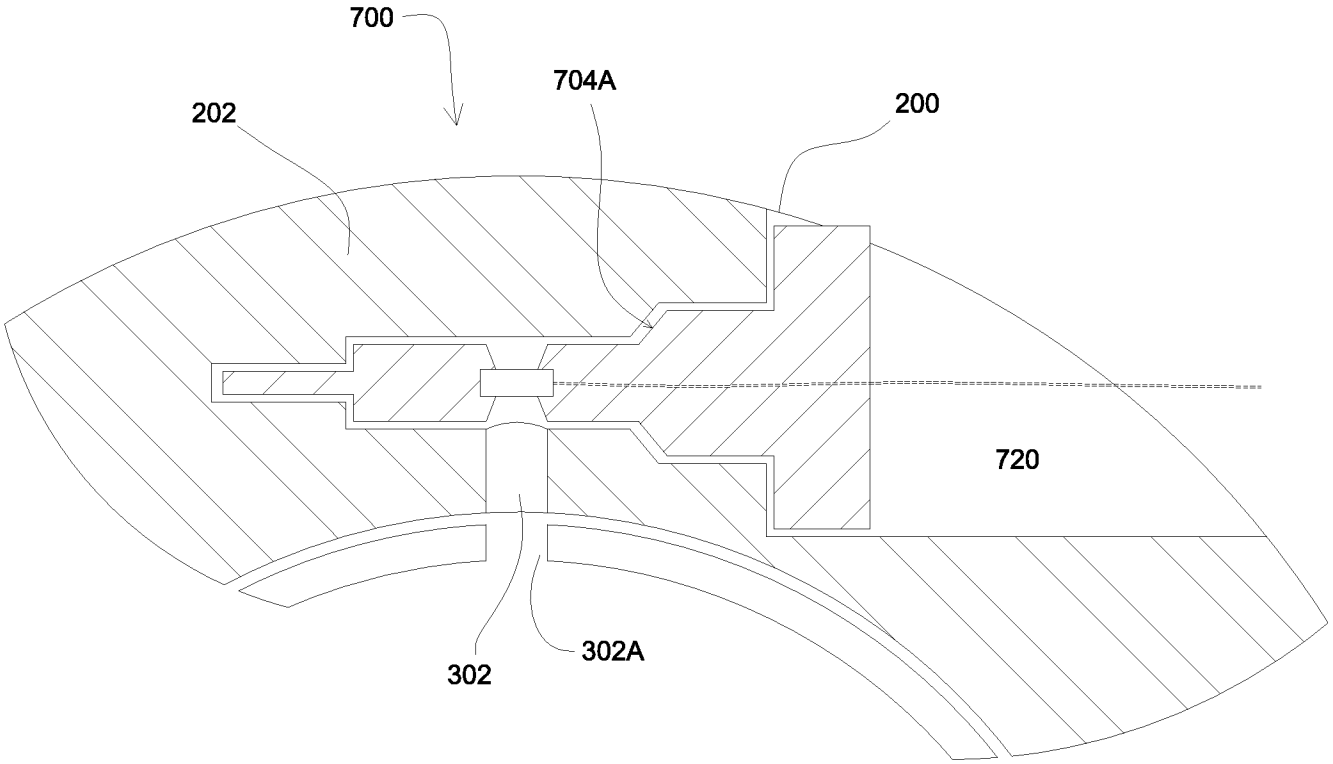
FIG. 9 is a schematic illustration of the fragment shown in FIG. 8, illustrated after detonation of the squib within the exploding bolt.

Referring to FIGS. 8 and 9, in other embodiments, for example, each one of the actuation subsystems 400, 500, independently, is in the form of an actuation subsystem 700. With respect to the sealed interface stimulator 306 of the actuation subsystem 700, the stimulation effected by the sealed interface stimulator 306 is with effect that a stimulated sealed interface 304 is obtained. The fluid-communicating passage 302, the sealed interface 304, and the sealed interface stimulator 306 are co-operatively configured such that, while the sealed interface 304 is disposed in the stimulated condition (in response to the stimulation by the sealed interface stimulator), fluid, that is communicated, via the fluid-communicating passage 302, from the housing passage 206 to the sealed interface 304, effects defeating of the sealed interface 304 (see FIG. 7). So long as the fluid-communicating passage 302 is not blocked by debris (e.g. residual cement), the defeating of the sealed interface 304 is with effect that fluid communication becomes established between the housing passage 206 and the pressure responsive surface 226, and, while the housing passage 206 is disposed in fluid communication with the pressure responsive surface 226 via the fluid-communicating passage 302, fluid, that is communicated, via the fluid-communicating passage, from the housing passage 206 to the fluid pressure responsive surface 226 of the flow control member 224, urges the displacement of the flow control member 224 relative to the flow communicator 218, with effect that displacement of the flow control member 224, from the closed position to the open position, is effected. In some embodiments, for example, the displacement effects an opening of the subterranean flow communicator 218. In this respect, in some embodiments, for example, the sealed interface stimulator 306 is in the form of an energetic device 706, such as, for example, a squib, and the sealed interface 304 is defined by a valve member 704 that is disposed for becoming structurally weaker in response to actuation of the energetic device 706. In some of these embodiments, the sealed interface stimulator 306 and the sealed interface 304 are combined in an exploding bolt 705 that is threaded to the housing 202. In response to actuation of the energetic device 706, the bolt 705 is weakened, and, while disposed in this weakened condition, fluid, that is being communicated from the housing passage 206, urges fracturing of the bolt 705 such that the sealed interface 704A becomes defeated, with effect that flow communication is effected between the housing passage 206 and the fluid responsive surface 226 of the respective flow control member 224 such that displacement of the respective flow control member 224 relative to the flow communicator 218 from the closed position to the open position is effected.

Each one of the actuation subsystems 600, 700, independently, includes a respective first chamber 320 and a respective second chamber 322. The first chamber 320 is disposed in flow communication with the fluid responsive surface 226 of the flow control member 224 for receiving pressurized fluid from the housing passage 206 via the fluid-communicating passage 302, while the sealed interface 304 is defeated. The second chamber 322 is configured for containing a fluid and disposed relative to the flow control member 224 such that fluid (e.g. liquid) contained within the second chamber 322 opposes the displacement of the flow control member 224 is being urged by pressurized fluid within the first chamber 320. The displacement of the flow control member 224, relative to the flow communicator 218, is effected when the force applied to the flow control member 224 by the pressurized fluid within the first chamber 320 exceeds the force applied to the flow control member 224 by the fluid within the second chamber 322. In some embodiments, for example, the displacement of the flow control member is effected when the pressure applied to the flow control member 224 by the pressurized fluid within the first chamber 320 exceeds the pressure applied to the flow control member 224 by the fluid within the second chamber 322. In some embodiments, for example, the fluid within the second chamber 322 is disposed at about atmospheric pressure. In some embodiments, for example, both of the first chamber 320 and the second chamber 322 are defined by respective spaces interposed between the housing 202 and the flow control member 224, and a chamber sealing member 324 is provided for effecting a sealed interface between the chambers, while the flow control member 224 is being displaced relative to the flow communicator 218.

In some embodiments, for example, while the flow communicator 218 is disposed in the open condition, closing of the flow communicator 218 is effectible in response to displacement (a "closing displacement") of the flow control member 224, relative to the flow communicator 218, in a direction opposite to that of the opening displacement of the flow control member 224. In some of these embodiments, for example, the opening displacement of the flow control member 224 is a displacement in the uphole direction, and the closing displacement is effected in response to a force applied to the flow control member 224 (such as, for example, by a shifting tool) in the downhole direction.

In other embodiments, for example, the closing is effected with a flow communication interference body (e.g. a ball or a plug) which becomes seated on a seating surface that has been obtained by deformation of a structure (e.g. the flow control member 224), effected in response to a force applied to the flow control member 224 while effecting opening of the flow communicator 218, during the opening displacement in the uphole direction. In this respect, in such embodiments, for example, the flow control apparatus 200 is configured in a manner described in International Patent Publication No. WO2018076119A1.

Figure 11:
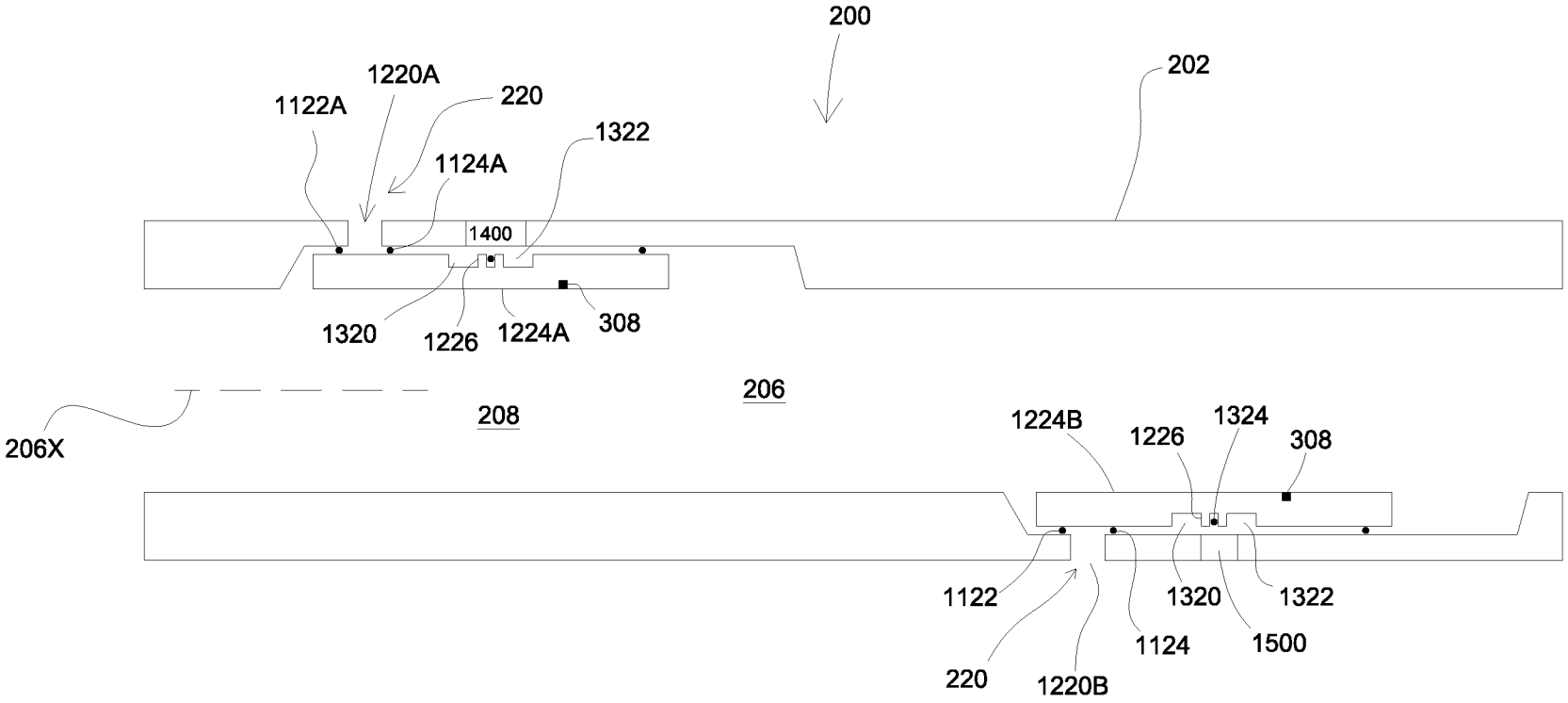
FIG. 11 is a side sectional view of another embodiment of a flow control apparatus for use in the system illustrated in FIG. 1, illustrating the subterranean flow communicator in the closed condition.

Referring to FIG. 11, also to mitigate against the above-described operational risks, in other embodiments, for example, the flow controller 222 is of a configuration such that the flow controller 222 includes two flow control members 1224A, 1124B, and the actuation system 1300 includes two actuation subsystems 1400, 1500, and each one of the two actuation systems, independently, is configured to actuate displacement of a respective one of the two flow control members 1224A, 1224B for effecting a change in condition of the flow communicator 218 from the closed condition to the open condition. In some of these embodiments, for example, the apparatus 200 of such configuration is useful as a toe sleeve.

The change in condition of the flow communicator 218, from the closed condition to the open condition, is effected by displacement of at least one of the flow control members 1224A, 1224B relative to the flow communicator 218. Each one of the flow control members 1224A, 1224B, independently, is displaceable, relative to the flow communicator 218. In some embodiments, for example, the flow communicator 218 includes a plurality of ports 220, and the plurality of ports 220 is defined by a first subset of ports 1220A and a second subset of ports 1220B. While the flow communicator 218 is disposed in the closed condition, one of the flow control members 1224A, 1224B is occluding a respective one of the first and second subsets of the ports 1220A, 1220B such that the one of the flow control members 1224A, 1224B is respective to the first subset of the ports 1220A, and the other one of the flow control members 1224A, 1224B is occluding the second subset of the ports 1220B such that the other one of the flow control members 1224A, 1224B is respective to the second subset of the ports 1220B. The change in condition of the flow communicator 218, from the closed condition to the open condition, includes a change in condition of at least one of the first and second subsets of ports 1220A, 1220B from a closed condition to an open condition. For each one of the at least one of the first and second subsets of the ports 1220A, 1220B, whose condition is changed from the closed condition to the open condition, the one of the two flow control members 1224A, 1224B, that is respective to the subset of ports 1220A (or 1220B), is displaced, relative to the subset of ports 1220A (or 1220B), from the closed position to the open position.

For each one of the flow control members 1224A, 1224B, displacement of the flow control member 1224A (or 1224B), relative to the flow communicator 218, from the closed position to the open position, effects flow communication, via the flow communicator 218, between the wellbore string 104 and the subterranean formation 100, such that the conducting of material between the wellbore string 104 and the subterranean formation 100, via the flow communication station, is enabled.

In some embodiments, for example, each one of the flow control members 1224A, 1224B, independently, is a sliding sleeve that is slideably disposed within the housing passage 206.

In some embodiments, for example, for each one of the flow control members 1224A, 1224B, while the flow control member 1224A (or 1224B) is disposed in the closed position, the flow control member 1224A (or 1224B) is disposed, relative to the respective subset of ports 1220A (or 1220B), such that a sealed interface is disposed between the wellbore string passage 106 and the subterranean formation 100, and the disposition of the sealed interface is such that the conduction of material between the wellbore string 104 and the subterranean formation 100, via the flow communication station (110, 112, or 114) is prevented, or substantially prevented. In some embodiments, for example, the sealed interface is established by sealing engagement, or substantially sealing engagement, between the flow control member 1224A (or 1224B) and the housing 202. In this respect, in some embodiments, for example, the housing 202 includes one or more sealing surfaces configured for sealing engagement with the respective one of the flow control members 1224A, 1224B, wherein the sealing engagement defines the sealed interface. In this respect, sealing surfaces 1122, 1124 are defined on an internal surface of the housing 202 for sealing engagement with the respective flow control member 1224A (or 1224B). In some embodiments, for example, each one of the sealing surfaces 1122, 1124 is defined by a respective sealing member. In some embodiments, for example, each one of the sealing members, independently, includes an o-ring. In some embodiments, for example, the o-ring is housed within a recess formed within the housing 202. In some embodiments, for example, the sealing member includes a molded sealing member (i.e. a sealing member that is fitted within, and/or bonded to, a groove formed within the sub that receives the sealing member). In some embodiments, for example, the respective subset of ports 1220A (or 1220B) extends through the housing 202, and is disposed between the sealing surfaces 1122, 1124. In those embodiments where, in the closed position, the respective one of the flow control members 1224A, 1224B is disposed in sealing engagement, or substantially sealing engagement, with the housing 202 (such that the sealed interface is established), displacement of the respective one of the flow control members 1224A, 1224B to the open position effects defeating of the sealed interface. In some of these embodiments, for example, the defeating of the sealed interface results in the respective one of the flow control members 1224A, 1224B becoming spaced apart, or retracted, from the sealing surfaces 1122, 1124.

In some embodiments, for example, while the flow control apparatus 200 is being run-in-hole, each one of the flow control members 1224A, 1224B, independently, is releasably retained relative to the housing 202 by one or more frangible interlocking members (not shown), such as, for example, one or more shear pins. In some of these embodiments, for example, for each one of the flow control members 1224A, 1224B, while releasably secured relative to the housing 202, the flow control member 1224A (or 1224B) is disposed relative to the respective subset of ports 1220A (or 1220B) such that the respective subset of ports 1220A (or 1220B) is disposed in the closed condition. In such embodiments, release of the flow control member 1224A (or 1224B) from the releasable retention relative to the housing 202 by the one or more frangible interlocking members, is effectible in response to a force applied to the flow control member 1224A (or 1224B) in a direction that is parallel, or substantially parallel, to the central longitudinal axis of the housing passage 206. In some embodiments, for example, the applied force is in the uphole direction. In some embodiments, for example, the applied force is in the downhole direction. The applied force functions to mechanically fracture the one or more frangible interlocking members, and thereby effect the release.

Upon such release, for each one of the flow control members 1224A, 1224B, the flow control member 1224A (or 1224B) becomes displaceable relative to the respective subset of ports 1220A (or 1220B), for effecting opening of the respective subset of ports 1220A (or 1220B). In this respect, for each one of the flow control members 1224A, 1224B, while the flow control member 1224A (or 1224B) is released from retention relative to the housing, in response to a force applied to the flow control member 1224A (or 1224B) in a direction that is parallel, or substantially parallel, to the central longitudinal axis of the housing passage 206, the flow control member 1224A (or 1224B) is displaced, relative to the respective subset of ports 1220A (or 1220B), for effecting opening of the respective subset of ports 1220A (or 1220B), such that the respective subset of ports 1220A (or 1220B) becomes disposed in the fully opened condition. In some embodiments, for example, the applied force is in an uphole direction, such that displacement (an "opening displacement") of the flow control member 1224A (or 1224B), for effecting the opening of the respective subset of ports 1220A (or 1220B), is in the uphole direction. In other embodiments, for example, the applied force is in the downhole direction, such that displacement of the flow control member 1224A (or 1224B), for effecting the opening of the respective subset of ports 1220A (or 1220B), is in the downhole direction.

Each one of the at least two actuation subsystems 1400, 1500, independently, is configured to actuate the displacement of a respective one of the two flow control members 1224A, 1224B from the closed position to the open position.

In those embodiments where each one of the flow control members 1224A, 1224B, independently, is releasably retained relative to the housing 202 by one or more frangible interlocking members while the flow control apparatus 200 is being run-in-hole, in some of these embodiments, for example, each one of the at least two actuation subsystems 1400, 1500, independently, is configured to, in sequence, actuate the release of a respective one of the flow control member 1224A (or 1224B) from the retention relative to the housing 202, and upon the release of the respective one of the flow control members 1224A, 1224B from the retention relative to the housing, actuate the displacement of the respective one of the flow control members 1224A, 1224B from the closed position to the open position.

Figure 12:
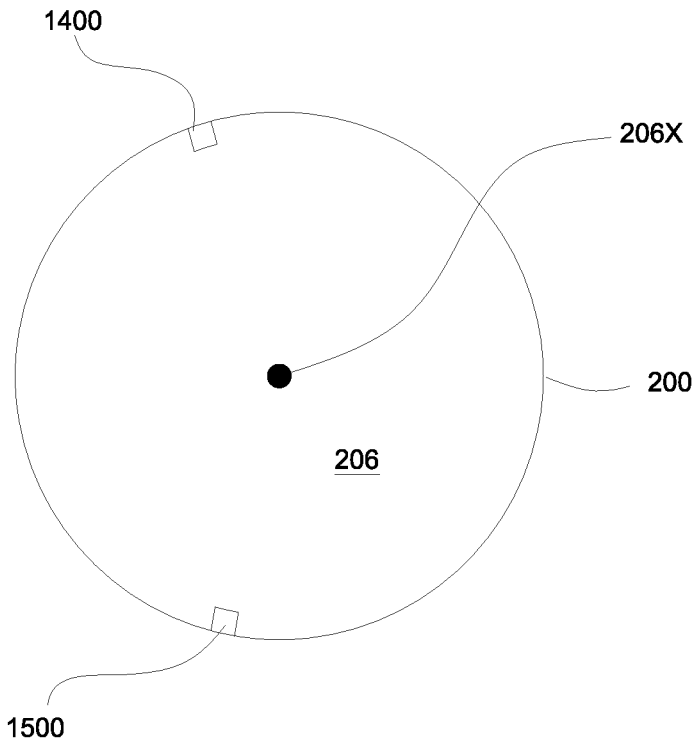
FIG. 12 is a schematic illustration of a section of the flow control apparatus in FIG. 11, illustrating the relative positioning of the actuation subsystems.

In this respect, in these embodiments, the apparatus 200 is provided with redundant actuatable flow control members 1224A, 1224B and, in case the reliability of one of the actuation subsystems 1400, 1500, for actuating displacement of the flow control member 1224A (or 1224B) to which the one of the actuation subsystems 1400, 1500 is respective, is compromised, the other one of the actuation subsystems 1400, 1500 is available for actuating displacement of the flow control member 1224A (or 1224B) to which the other one of the actuation subsystems 1400, 1500 is respective Referring to FIG. 12, in some embodiments, for example, relative to the central longitudinal axis 206X of the housing passage 206, one of the actuation subsystems 1400, 1500 is angularly spaced from the other one of the actuation subsystems 1400, 1500, such as, for example, by an angle of between about 45 degrees and about 315 degrees, such as, for example, between about 90 degrees and about 270 degrees, such as, for example, between about 135 degrees and about 225 degrees, such as, for example, between about 165 degrees and 195 degrees. In some embodiments, for example, the angular spacing is about 180 degrees. In this respect, in some embodiments, the above-described operational risks are more pronounced when an actuation system is disposed closer to the lowermost point within the wellbore string 104, and, in the event that one of the actuation subsystems 1400, 1500 (the potentially compromised actuation system) is disposed in proximity to the lowermost point within the wellbore string 104, it is desirable that the other one of the actuation subsystems 1400, 1500 is not also disposed in proximity to the lowermost point within the wellbore string 104, and, hence, is angularly spaced from the potentially compromised actuation system.

In some embodiments, for example, the actuating subsystems 1400, 1500 are aligned, or substantially aligned, with each other. In other embodiments, for example, the actuating subsystems 1400, 1500 are axially spaced apart from one another. In this respect, in some embodiments, for example, the first actuating subsystem 1400 is disposed in a first plane that is perpendicular to the central longitudinal axis 206X of the housing passage 206, and the second actuation subsystem 1500 is disposed in a second plane that is perpendicular to the central longitudinal axis 206X of the housing passage 206, and the first and second planes are spaced apart from each other by a distance, measured along the central longitudinal axis 206X, of less than about twelve (12) feet, such as, for example, less than about six (6) feet, such as, for example, less than about three (3) feet. In some embodiments, for example, the distance is between about three (3) feet and about six (6) feet.

In some embodiments, for example, each one of the actuation subsystems 1400, 1500, independently, is configured to effect the displacement of a respective one of the flow control members 1224A, 1224B relative to the respective subset of ports 1220A (or 1220B) in response to the above-described transmitted signal. In this respect, in some embodiments, for example, the signal sensor configuration 308 includes at least two signal sensors 308A, and each one of the actuation subsystems 1400, 1500, independently, is configured to effect the displacement of the flow control member 1224A (or 1224B) relative to the respective subset of ports 1220A (or 1220B) in response to the sensing of the transmitted signal by a respective one of the signal sensors 308A.

In some embodiments, for example, each one of the signal sensors 308A, independently, is disposed for sensing a wirelessly transmitted signal. As above-described, in some embodiments, for example, the wirelessly transmitted signal is a seismic signal. As well, in some embodiments, for example, the wirelessly transmitted signal is a signal transmitted via fluid within the wellbore string passage 106. In this respect, in some embodiments, for example, the each one of the signal sensors 308A, independently, is mounted within the housing 202 and extends into the housing passage 206, such that the signal sensors 308A are disposed within the housing passage 206 for sensing wirelessly transmitted signals that are being transmitted through the housing passage 206.

The sensor 308A of the actuation subsystem 1400 may be configured to be actuated by a different wirelessly transmitted actuation signal than the sensor 308A of the actuation subsystem 1500, and thereby allow the actuation subsystems 1400, 1500 to be selectively actuated. If both of the actuation subsystems 1400, 1500 are to be actuated, the actuation signals for both of the actuation subsystems 1400, 1500 are transmitted.

In some embodiments, for example, the transmitted actuation signal is a pressure signal, such as one or more pressure pulses. In some embodiments, for example, the transmitted actuation signal is defined by a pressure pulse characterized by at least a magnitude. In some embodiments, for example, the transmitted signal is defined by a pressure pulse characterized by at least a duration. In some embodiments, for example, the transmitted actuation signal is defined by a pressure pulse characterized by a combination of at least a magnitude and a duration. Different pressure pulse signals may be used to actuate the actuation subsystems 1400 or 1500, respectively.

In some embodiments, for example, the transmitted actuation signal is defined by a plurality of pressure pulses. In some embodiments, for example, the transmitted actuation signal is defined by a plurality of pressure pulses, each one of the pressure pulses characterized by at least a magnitude. In some embodiments, for example, the transmitted actuation signal is defined by a plurality of pressure pulses, each one of the pressure pulses characterized by at least a magnitude and a duration. In some embodiments, for example, the transmitted actuation signal is defined by a plurality of pressure pulses, each one of the pressure pulses characterized by at least a duration. In some embodiments, for example, each one of pressure pulses is characterized by time intervals between the pulses. Different signals comprising a different series of plurality of pressure pulses may be used to actuate the actuation subsystems 1400 or 1500, respectively.

In some embodiments, for example, the transmitted actuation signal is defined by a pressure and hold signal. A pressure and hold signal is a sustained pressure signal. The pressure and hold signal may be defined by a pressure signal that is sustained for a duration of time, which comprise a number of seconds or a number of minutes, for example. Different pressure and hold signals may be used to actuate the actuation subsystems 1400 or 1500, respectively. For example, both pressure and hold signals may have the same pressure but a different duration, e.g. one sensor 308A may be configured to actuate one of the actuation subsystems 1400 or 1500 after a sustained pressure P for a time t, whereas the other sensor 308A may be configured to actuate the other of the actuation subsystems 1400 or 1500 after a sustained pressure P for a time t+x.

In this respect, in those embodiments where the transmitted signal is a pressure signal being transmitted via fluid within the wellbore string passage 106, in some of these embodiments, for example, each one of the signal sensors 308A, independently, is a pressure sensor. An exemplary pressure sensor is a Kellar Pressure Transducer Model 6LHP/81188TM. Other suitable sensors may be employed, depending on the nature of the signal being used for the actuating signal. Other suitable sensors include a Hall effect sensor, a radio frequency identification ("RFID") sensor, or a sensor that can detect a change in chemistry (such as, for example, pH), or radiation levels, or ultrasonic waves.

Figure 13:
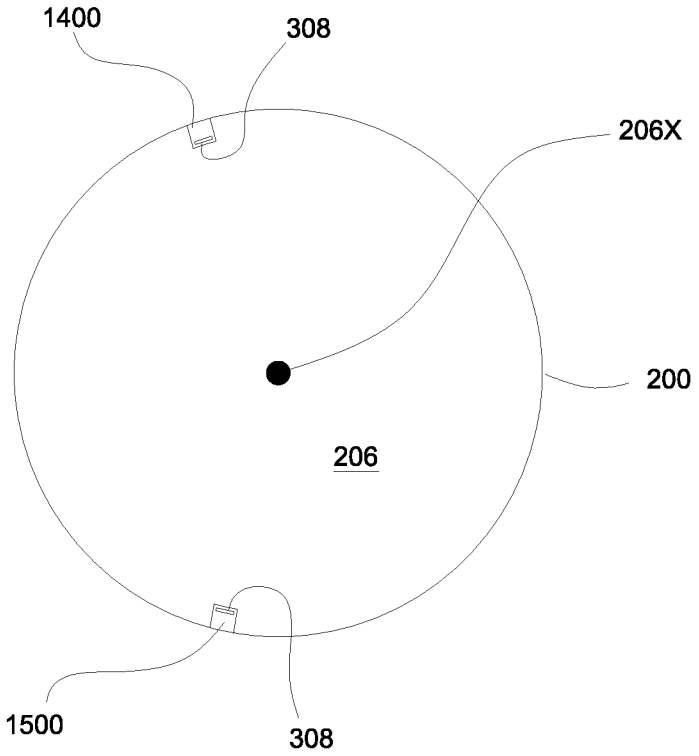
FIG. 13 is a schematic illustration of a section of the flow control apparatus in FIG. 11, illustrating the relative positioning of the sensors of the actuation subsystems.

Referring to FIG. 13, for further addressing the reliability of actuation of the displacement of at least one of the flow control members 1224A, 1224B, in some embodiments, for example, relative to the central longitudinal axis 206X of the housing passage 206, the signal sensor 308A that is respective to the first actuation subsystem 1400 is angularly spaced from the signal sensor 308A that is respective to the second actuation subsystem 1500. In those embodiments where the signal sensor 308A is extending into the housing passage, by providing this configuration, there is a decreased risk that solid debris (e.g. residual cement), present within the wellbore string passage 106, will interfere with the sensing, by an actuation system 300, of an actuation signal that is being transmitted downhole. In some of these embodiments, for example, the angular spacing between the signal sensor 308A that is respective to the first actuation subsystem 1400 and the signal sensor 308A that is respective to the second actuation subsystem 1500 is between about 45 degrees and about 315 degrees, such as, for example, between about 90 degrees and about 270 degrees, such as, for example, between about 135 degrees and about 225 degrees, such as, for example, between about 165 degrees and 195 degrees. In some embodiments, for example, the angular spacing is about 180 degrees.

In some embodiments, for example, the signal sensor 308A that is respective to the first actuation subsystem 1400 is aligned, or substantially aligned, with the signal sensor 308A that is respective to the second actuation subsystem 1500. In other embodiments, for example, the signal sensor 308A that is respective to the first actuation subsystem 1400 is axially spaced from the signal sensor 308A that is respective to the second actuation subsystem 1500. In this respect, in some embodiments, for example, the signal sensor 308A that is respective to the first actuation subsystem 1400 is disposed in a first plane that is perpendicular to the central longitudinal axis 206X of the housing passage 206, and the signal sensor 308A that is respective to the first actuation subsystem 1400 is disposed in a second plane that is perpendicular to the central longitudinal axis 206X of the housing passage 206, and the first and second planes are spaced apart from each other by a distance, measured along the central longitudinal axis 206X, of less than about twelve (12) feet, such as, for example, less than about six (6) feet, such as, for example, less than about three (3) feet. In some embodiments, for example, the distance is between about three (3) feet and about six (6) feet.

Referring to FIGS. 14 to 17, in some embodiments, for example, each one of the actuation systems 1400, 1500, independently, further includes a respective fluid-communicating passage 1302 and a respective fluid communication controller. Each one of the fluid communication controllers, independently, includes a respective sealed interface 1304 and a respective sealed interface stimulator 1306.

For each one of the actuation systems 1400, 1500, independently, the fluid-communicating passage 1302 extends between the housing passage 206 and a fluid pressure responsive surface 1226 of the respective one of the flow control members 1224A, 1224B for effecting fluid communication, between fluid within the housing passage 206 and the fluid pressure responsive surface 1226 of the respective one of the flow control members 1224A, 1224B, for urging displacement of the respective one of the flow control members 1224A, 1224B relative to the respective subset of ports 1220A (or 1220B) (from the closed position to the open position). In some embodiments, for example, the fluid-communicating passage extends through a passage 1228 defined within the respective one of the flow control members 1224A, 1224B. In some embodiments, for example, the fluid-communicating passage 1302 includes a port 1302A that merges with the housing passage 206. The sealed interface 1304 is disposed within the fluid-communicating passage 1302. In some embodiments, for example, the sealed interface 1304 effects sealing, or substantial sealing, of fluid communication between the housing passage 206 and the fluid pressure responsive surface 1226 of the respective one of the flow control members 1224A, 1224B. The sealed interface stimulator 1306 is configured for effecting stimulation of the sealed interface 1304, with effect that the sealed interface 1304 becomes disposed in a stimulated condition. The sealed interface 1304, the sealed interface stimulator 1306, and the signal sensor 308A are co-operatively configured such that, in response to the sensing of the transmitted signal by the signal sensor 308A, the first sealed interface stimulator 1306 effects stimulation of the sealed interface 1304.

Figure 19:
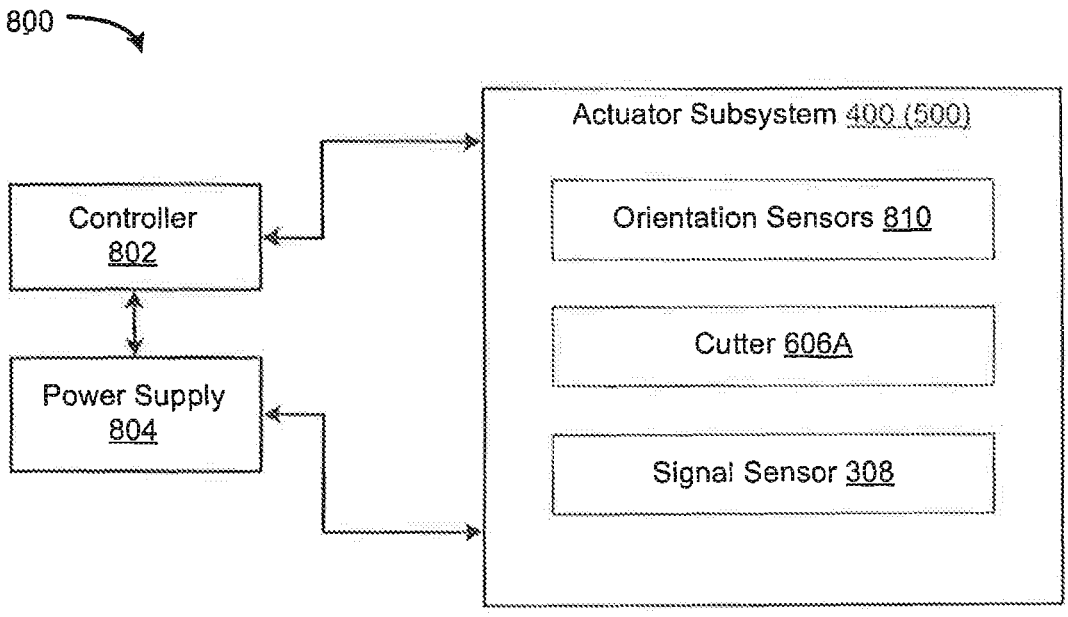
FIG. 19 is a schematic diagram of a control system in accordance with one example embodiment of the present disclosure.

Referring to FIG. 19, also for further addressing the reliability of actuation of the displacement of at least one of the flow control members 1224A, 1224B, in some embodiments, for example, relative to the central longitudinal axis 206X of the housing passage 206, the communication port 1302A of the first actuation system 1400 is angularly spaced from the communication port 1302A of the second actuation system 1500. In some of these embodiments, for example, by providing this configuration, there is a decreased risk that sold debris (e.g. residual cement), present within the well-bore string passage 106, will block fluid communication between the housing passage 206 and the fluid pressure responsive surface 1226. In some of these embodiments, for example, the angular spacing between the communication port 1302A of the first actuation system 1400 and the communication port 1302A of the second actuation system 1500 is between about 45 degrees and about 315 degrees, such as, for example, between about 90 degrees and about 270 degrees, such as, for example, between about 135 degrees and about 225 degrees, such as, for example, between about 165 degrees and 195 degrees. In some embodiments, for example, the angular spacing is about 180 degrees.

It is, however, understood, that actuation of the at least one of the flow control members 1224A, 1224B can be effected in response to communication between fluid that is disposed externally of the housing 202 and the fluid pressure responsive surface 226 of the flow control member 224, for urging displacement of the flow control member 224 relative to the subterranean flow communicator 218, and, in this respect, the port 1302A can be disposed on an external surface of the housing 202. Also, it is understood that the signal sensor 308 can be disposed for sensing wireless signals being transmitted externally of the housing 202.

In some embodiments, for example, the communication port 1302A of the first actuation subsystem 1400 is aligned, or substantially aligned, with the communication port 1302A of the second actuation subsystem 1500. In other embodiments, for example, the communication port 1302A of the first actuation subsystem 1400 is axially spaced from the communication port 1302A of the second actuation subsystem 1500. In this respect, in some embodiments, for example, the communication port 1302A of the first actuation subsystem 1400 is disposed in a first plane that is perpendicular to the central longitudinal axis 206X of the housing passage 206, and the communication port 1302A of the first actuation subsystem 1400 is disposed in a second plane that is perpendicular to the central longitudinal axis 206X of the housing passage 206, and the first and second planes are spaced apart from each other by a distance, measured along the central longitudinal axis 206X, of less than about twelve (12) feet, such as, for example, less than about six (6) feet, such as, for example, less than about three (3) feet. In some embodiments, for example, the distance is between about three (3) feet and about six (6) feet.

Figure 14:
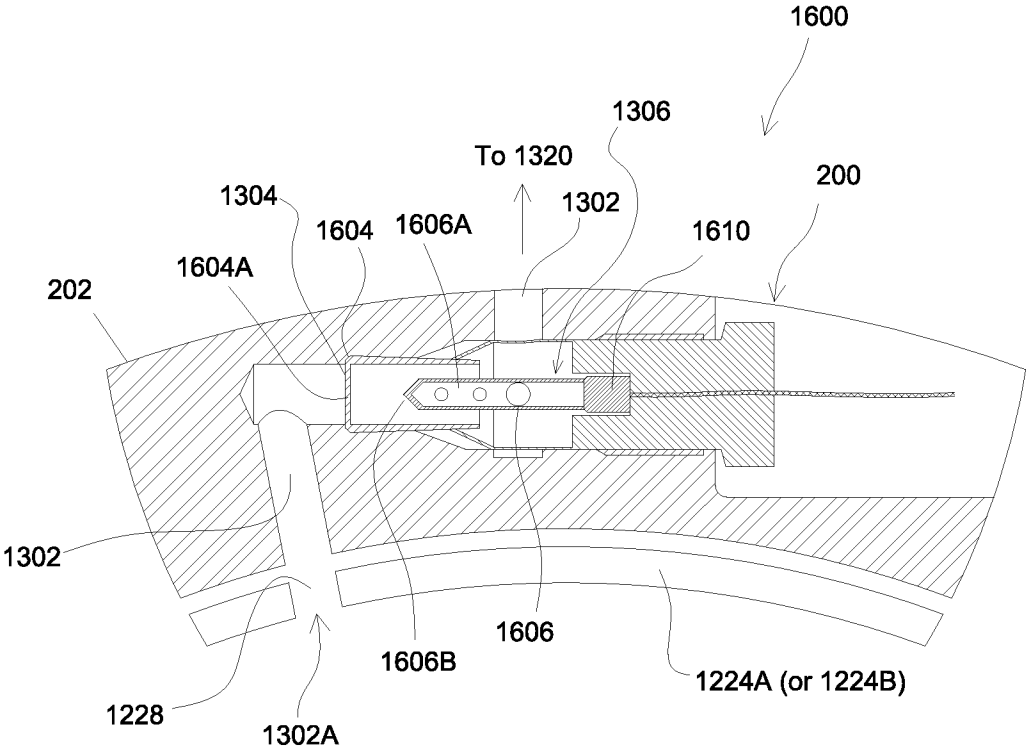
FIG. 14 is a schematic illustration of a fragment of the flow control apparatus illustrated in FIG. 11, having a cutter as its sealed interface stimulator, illustrated prior to the puncturing of a rupture disc.
Figure 15:
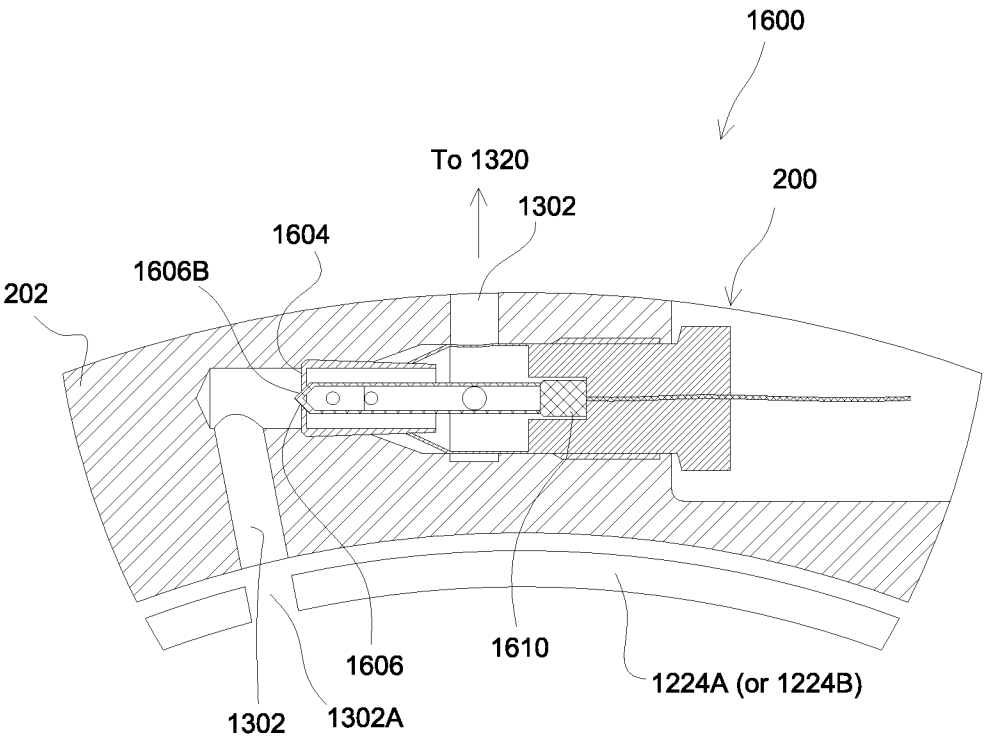
FIG. 15 is a schematic illustration of the fragment shown in FIG. 14, illustrated after the puncturing of a rupture disc by the cutter.

Referring to FIGS. 14 and 15, in some embodiments, for example, each one of the actuation subsystems 1400, 1500, independently, is in the form of an actuation subsystem 1600. With respect to the sealed interface stimulator 1306 of the actuation subsystem 1600, the sealed interface stimulator 1306 is a sealed interface defeater configured for effecting defeating of the sealed interface 1304. In this respect, the stimulation, effected by the sealed interface stimulator 1306, includes a defeating of the sealed interface 1304. So long as the fluid-communicating passage 1302 is not blocked by debris (e.g. residual cement), the defeating of the sealed interface 1304 is with effect that fluid communication becomes established between the housing passage 206 and the pressure responsive surface 1226 of the respective one of the flow control members 1224A, 1224B, and, while the housing passage 206 is disposed in fluid communication with the pressure responsive surface 1226 of the respective one of the flow control members 1224A, 1224B via the fluid-communicating passage 1302, fluid, that is communicated, via the fluid-communicating passage, from the housing passage 206 to the pressure responsive surface 1226 of the respective one of the flow control members, urges the displacement of the respective one of the flow control members 1224A, 1224B relative to the respective subset of ports 1220A (or 1220B), from the closed position to the open position, with effect that the displacement of the respective one of the flow control members 1224A, 1224B from the closed position to the open position is effected. In this respect, in some embodiments, for example, the sealed interface stimulator 1306 is in the form of a cutter 1606, and the sealed interface 1304 is defined by a rupture disc 1604. The cutter 1606 is configured for puncturing the rupture disc 1604 in response to the sensing of an actuating signal by the signal sensor 308. The puncturing of the rupture disc 1604 by the cutter 1606 is with effect that the sealed interface 1304 (defined by the rupture disc 1604) is defeated (see FIG. 5). In some embodiments, for example, the cutter 1606 includes a bayonet 1606A, threaded to the housing 602, and that is actuatable, by an energetic device 1610 (such as, for example, a squib), relative to the rupture disc 1604, for puncturing the rupture disc. Upon actuation by the energetic device 1610, the bayonet 1604A punctures the rupture disc 1604, such that flow communication is effected between the housing passage 206 and the fluid responsive surface 1226 of the respective one of the flow control members 1224A, 1224B, such that displacement of the respective one of the flow control members 1224A, 1224B relative to the respective subset of ports 1220A (or 1220B) from the closed position to the open position is effected.

Figure 16:
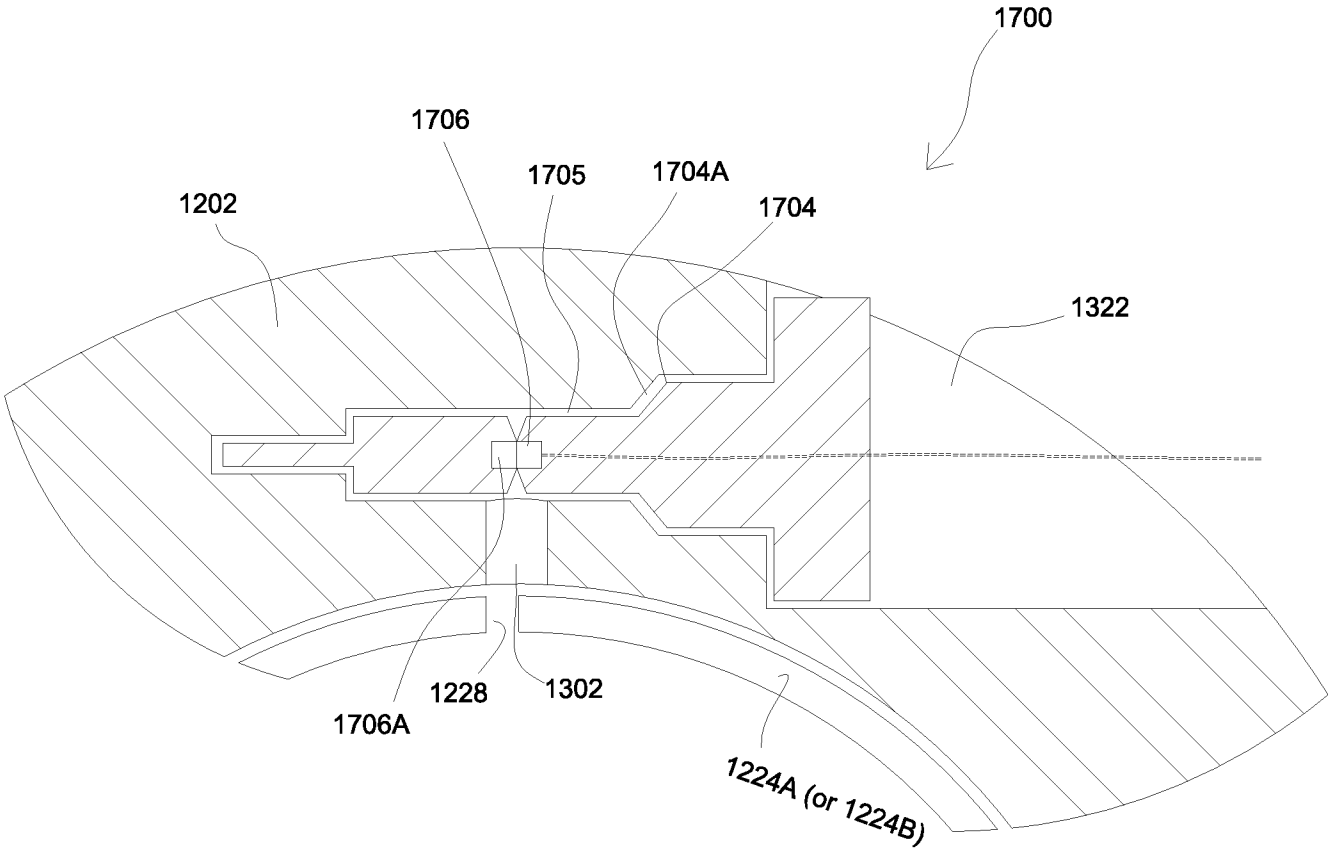
FIG. 16 is a schematic illustration of a fragment of another embodiment of the flow control apparatus illustrated in FIG. 11, having an exploding bolt as a combination sealed interface and sealed interface stimulator, illustrated prior to defeating of the sealed interface.
Figure 17:
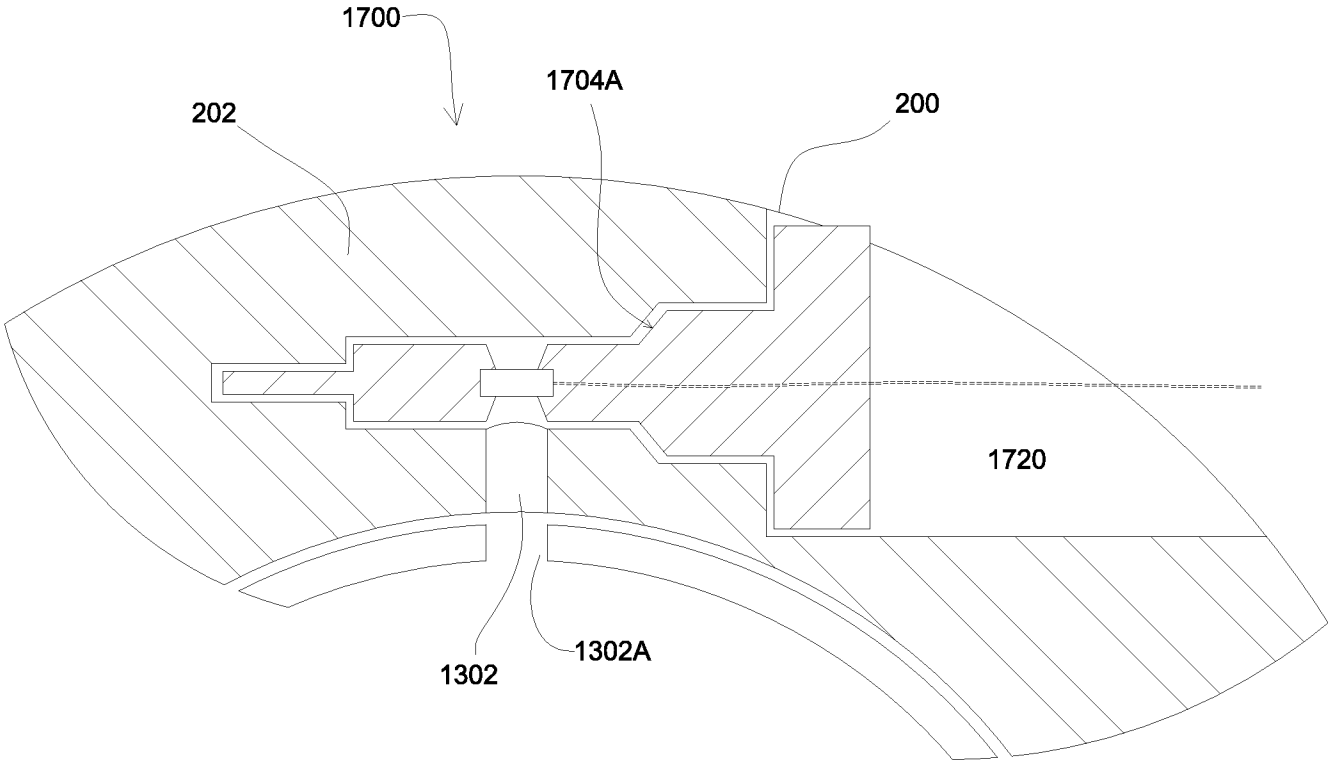
FIG. 17 is a schematic illustration of the fragment shown in FIG. 16, illustrated after detonation of the squib within the exploding bolt.
Figure 18:
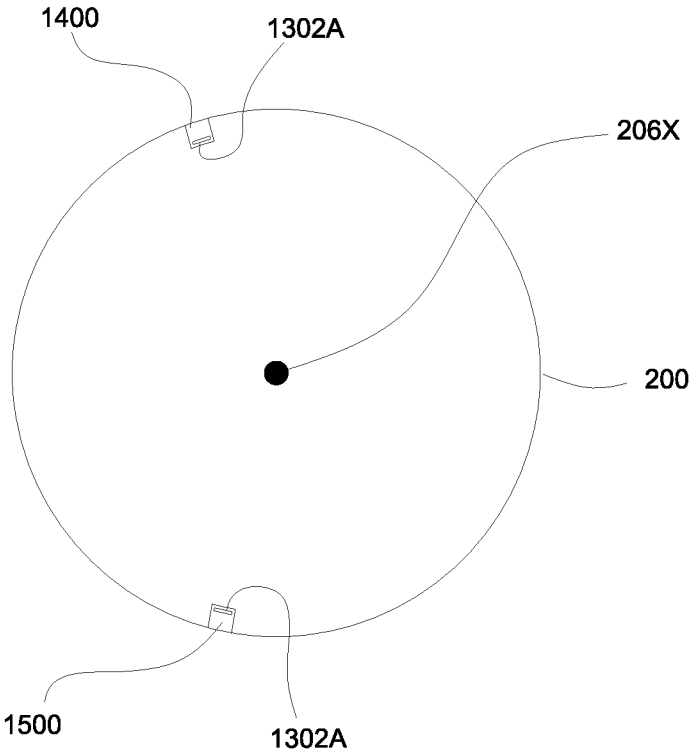
FIG. 18 is a schematic illustration of a section of the flow control apparatus in FIG. 11, illustrating the relative positioning of the communication ports of the actuation subsystems.

Referring to FIGS. 16 and 17, in other embodiments, for example, each one of the actuation subsystems 1400, 1500, independently, is in the form of an actuation subsystem 1700. With respect to the sealed interface stimulator 1306 of the actuation subsystem 1700, the stimulation effected by the sealed interface stimulator 1306 is with effect that a stimulated sealed interface 1304 is obtained. The fluid-communicating passage 1302, the sealed interface 1304, and the sealed interface stimulator 1306 are co-operatively configured such that, while the sealed interface 1304 is disposed in the stimulated condition (in response to the stimulation by the sealed interface stimulator), fluid, that is communicated, via the fluid-communicating passage 1302, from the housing passage 206 to the sealed interface 1304, effects defeating of the sealed interface 1304 (see FIG. 7). So long as the fluid-communicating passage 1302 is not blocked by debris (e.g. residual cement), the defeating of the sealed interface 1304 is with effect that fluid communication becomes established between the housing passage 206 and the pressure responsive surface 1226 of the respective one of the flow control members 1224A, 1224B, and, while the housing passage 206 is disposed in fluid communication with the pressure responsive surface 1226 of the respective one of the flow control members 1224A, 1224B via the fluid-communicating passage 1302, fluid, that is communicated, via the fluid-communicating passage, from the housing passage 206 to the fluid pressure responsive surface 1226 of the respective one of the flow control members 1224A, 1224B, urges the displacement of the respective one of the flow control members 1224A, 1224B relative to the respective subset of ports 1220A (or 1220B), with effect that displacement of the respective one of the flow control members 1224A, 1224B, from the closed position to the open position, is effected. In this respect, in some embodiments, for example, the sealed interface stimulator 1306 is in the form of an energetic device 1306, such as, for example, a squib, and the sealed interface 1304 is defined by a valve member 1704 that is disposed for becoming structurally weaker in response to actuation of the energetic device 1706. In some of these embodiments, the sealed interface stimulator 1306 and the sealed interface 1304 are combined in an exploding bolt 1705 that is threaded to the housing 202. In response to actuation of the energetic device 1706, the bolt 1705 is weakened, and, while disposed in this weakened condition, fluid, that is being communicated from the housing passage 206, urges fracturing of the bolt 1705 such that the sealed interface 1704A becomes defeated, with effect that flow communication is effected between the housing passage 206 and the fluid responsive surface 1226 of the respective one of the flow control members 1224A, 1224B such that displacement of the respective one of the flow control members 1224A, 1224B relative to the respective subset of ports 1220A (or 1220B) from the closed position to the open position is effected.

Each one of the actuation subsystems 1600, 1700, independently, includes a respective first chamber 1320 and a respective second chamber 1322. The first chamber 1320 is disposed in flow communication with the fluid responsive surface 1226 of the respective one of the flow control members 1224A, 1224B for receiving pressurized fluid from the housing passage 206 via the fluid-communicating passage 1302, while the sealed interface 1304 is defeated. The second chamber 1322 is configured for containing a fluid and disposed relative to the flow control member 1224A (or 1224B) such that fluid (e.g. liquid) contained within the second chamber 1322 opposes the displacement of the respective one of the flow control members 1224A, 1224B is being urged by pressurized fluid within the first chamber 1320. The displacement of the respective one of the flow control members 1224A, 1224B, relative to the respective subset of ports 1220A (or 1220B), is effected when the force applied to the respective one of the flow control members 1224A, 1224B by the pressurized fluid within the first chamber 1320 exceeds the force applied to the respective one of the flow control members 1224A, 1224B by the fluid within the second chamber 1322. In some embodiments, for example, the displacement of the respective one of the flow control members 1224A, 1224B is effected when the pressure applied to the respective one of the flow control members 1224A, 1224B by the pressurized fluid within the first chamber 1320 exceeds the pressure applied to the respective one of the flow control members 1224A, 1224B by the fluid within the second chamber 1322. In some embodiments, for example, the fluid within the second chamber 1322 is disposed at about atmospheric pressure. In some embodiments, for example, both of the first chamber 1320 and the second chamber 1322 are defined by respective spaces interposed between the housing 202 and the flow control member 1224A (or 1224B), and a chamber sealing member 1324 is provided for effecting a sealed interface between the chambers, while the respective one of the flow control members 1224A, 1224B is being displaced relative to the respective subset of ports 1220A (or 1220B).

In some embodiments, for example, instead of incorporating a fluid communication controller (including the combination of a sealed interface and a sealed interface stimulator) for enabling fluid communication via fluid-communicating passage 1302 for effecting actuation of the flow control member (1224A or 1224B), one or both of the actuation subsystems 1400, 1500 can be configured such that the sealed interface is in the form of a rupture disc that is configured for mechanically fracturing in response to receiving application of a threshold fluid pressure from within the wellbore. In this respect, the application of fluid pressure above a predetermined minimum pressure effects mechanical fracture of the rupture disc, thereby effecting fluid communication between a fluid pressure responsive surface of the flow control member (1224A or 1224B) and the housing passage 206, so that the fluid pressure can act on the flow control member and effect its displacement.

Figure 24:
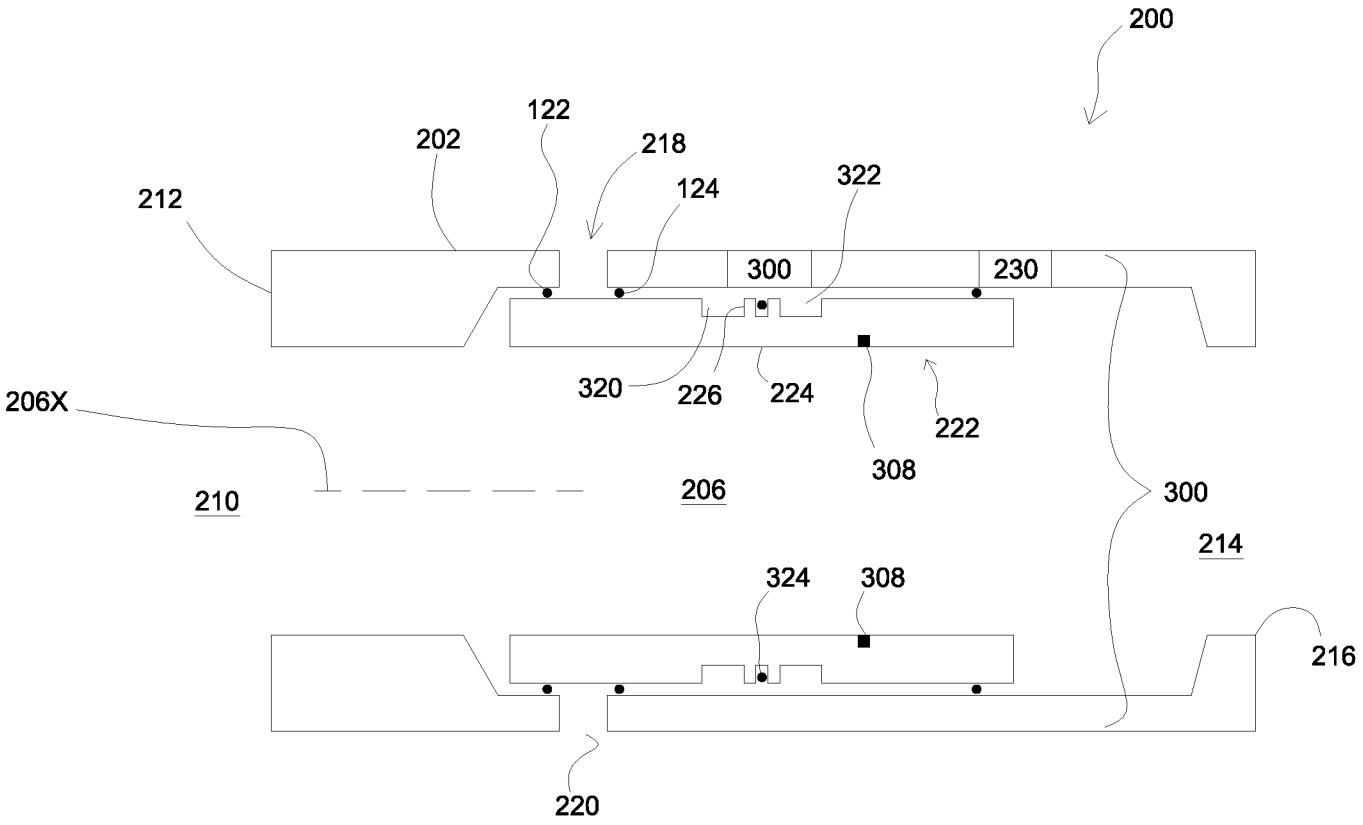
FIG. 24 is a side sectional view of another embodiment of a flow control apparatus for use in the system illustrated in FIG. 1, illustrating the subterranean flow communicator in the closed condition.
Figure 25:
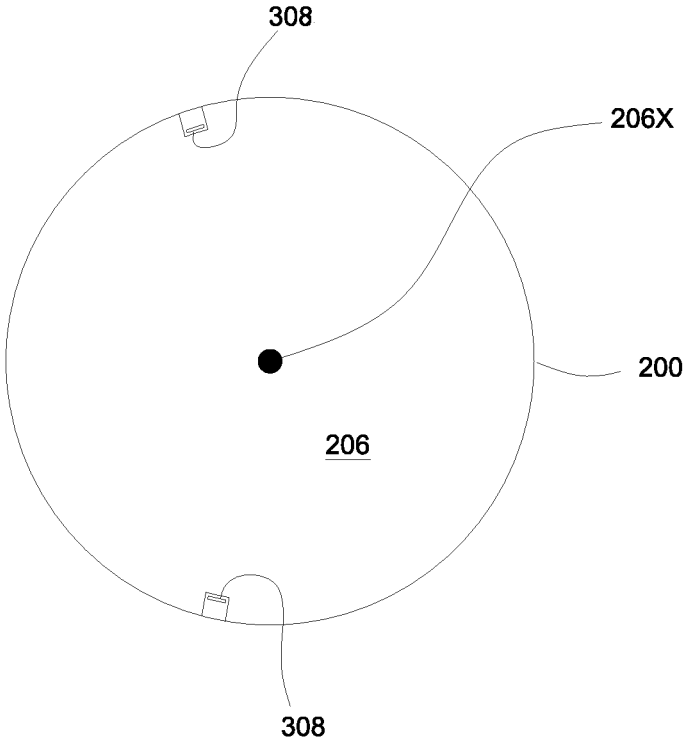
FIG. 25 is a schematic illustration of a section of the flow control apparatus in FIG. 24, illustrating the relative positioning of the sensors.

Referring to FIGS. 24 and 25, and also to mitigate against the above-described operational risks, in some embodiments, for example, the flow controller 222 is of a configuration such that the flow controller 222 includes a flow control member 224, and the signal sensor configuration 308 includes a first signal sensor 3081 and a second signal sensor 3082. The first signal sensor 3081 is coupled to the actuation system 300 and disposed for sensing a wirelessly transmitted signal, such that, in response to the sensing of the transmitted signal by the first signal sensor 3081, the actuation system 300 actuates displacement of the flow control member 224, with effect that there is a change in the condition of the flow communicator 218 from the closed condition to the open condition. The first signal sensor 3081 is disposed in communication with the housing passage 206 for sensing a wirelessly transmitted signal that is transmitted through the housing passage 206. Similarly, the second signal sensor 3082 is coupled to the actuation system 300 and disposed for sensing a wirelessly transmitted signal, such that, in response to the sensing of the transmitted signal by the second signal sensor 3082, the actuation system 300 actuates displacement of the flow control member 224, with effect that there is a change in the condition of the flow communicator 218 from the closed condition to the open condition. The second signal sensor 3082 is disposed in communication with the housing passage 206 for sensing a wirelessly transmitted signal that is transmitted through the housing passage 206.

The change in condition of the flow communicator 218, from the closed condition to the open condition, is effected by displacement of the flow control member 224 relative to the flow communicator 218. The flow control member 224 is displaceable, relative to the flow communicator 218, from a closed position to an open position. The closed position of the flow control member 224 corresponds to the closed condition of the flow communicator 218, and the open position of the flow control member 224 corresponds to the open condition of the flow communicator 218. Displacement of the flow control member 224, relative to the flow communicator 218, from the closed position to the open position, effects flow communication, via the flow communicator 218, between the wellbore string 104 and the subterranean formation 100, such that the conducting of material between the wellbore string 104 and the subterranean formation 100, via the flow communication station, is enabled.

In some embodiments, for example, the flow control member 224 is a sliding sleeve that is slideably disposed within the housing passage 206.

In some embodiments, for example, while the flow control member 224 is disposed in the closed position, the flow control member 224 is disposed, relative to the flow communicator 218, such that a sealed interface is disposed between the wellbore string passage 106 and the subterranean formation 100, and the disposition of the sealed interface is such that the conduction of material between the wellbore string 104 and the subterranean formation 100, via the flow communication station (110, 112, or 114) is prevented, or substantially prevented. In some embodiments, for example, the sealed interface is established by sealing engagement, or substantially sealing engagement, between the flow control member 224 and the housing 202. In this respect, in some embodiments, for example, the housing 202 includes one or more sealing surfaces configured for sealing engagement with the flow control member 224, wherein the sealing engagement defines the sealed interface. In this respect, sealing surfaces 122, 124 are defined on an internal surface of the housing 202 for sealing engagement with the flow control member 224. In some embodiments, for example, each one of the sealing surfaces 122, 124 is defined by a respective sealing member. In some embodiments, for example, each one of the sealing members, independently, includes an o-ring. In some embodiments, for example, the o-ring is housed within a recess formed within the housing 202. In some embodiments, for example, the sealing member includes a molded sealing member (i.e. a sealing member that is fitted within, and/or bonded to, a groove formed within the sub that receives the sealing member). In some embodiments, for example, the flow communicator 218 extends through the housing 202, and is disposed between the sealing surfaces 122, 124. In those embodiments where, in the closed position, the flow control member 224 is disposed in sealing engagement, or substantially sealing engagement, with the housing 202 (such that the sealed interface is established), displacement of the flow control member 224 to the open position effects defeating of the sealed interface. In some of these embodiments, for example, the defeating of the sealed interface results in the flow control member 224 becoming spaced apart, or retracted, from the sealing surfaces 122, 124.

In some embodiments, for example, while the flow control apparatus 200 is being run-in-hole, the flow control member 224 is releasably retained relative to the housing 202 by one or more frangible interlocking members (not shown), such as, for example, one or more shear pins. In some of these embodiments, for example, while releasably secured relative to the housing 202, the flow control member 224 is disposed relative to the flow communicator 218 such that the flow communicator 218 is disposed in the closed condition (see FIG. 2). In such embodiments, release of the flow control member 224 from the releasable retention relative to the housing 202 by the one or more frangible interlocking members, is effectible in response to a force applied to the flow control member 224 in a direction that is parallel, or substantially parallel, to the central longitudinal axis of the housing passage 206. In some embodiments, for example, the applied force is in the uphole direction. In some embodiments, for example, the applied force is in the downhole direction. The applied force functions to mechanically fracture the one or more frangible interlocking members, and thereby effect the release.

Upon such release, the flow control member 224 becomes displaceable relative to the flow communicator 218, for effecting opening of the flow communicator 218. In this respect, while the flow control member 224 is released from retention relative to the housing, in response to a force applied to the flow control member 224 in a direction that is parallel, or substantially parallel, to the central longitudinal axis of the housing passage 206, the flow control member 224 is displaced, relative to the flow communicator 218, for effecting opening of the flow communicator 218, such that the flow communicator 218 becomes disposed in the fully opened condition (see FIG. 3). In some embodiments, for example, the applied force is in an uphole direction, such that displacement (an "opening displacement") of the flow control member 224, for effecting the opening of the flow communicator 218, is in the uphole direction. In other embodiments, for example, the applied force is in the downhole direction, such that displacement of the flow control member 224, for effecting the opening of the flow communicator 218, is in the downhole direction.

The actuation system 300 is configured to actuate the displacement of the flow control member 224 from the closed position to the open position. In those embodiments where the flow control member 224 is releasably retained relative to the housing 202 by one or more frangible interlocking members while the flow control apparatus 200 is being run-in-hole, in some of these embodiments, for example, the actuation system 300 is configured to, in sequence, actuate the release of the flow control member 224 from the retention relative to the housing 202, and upon the release of the flow control member 224 from the retention relative to the housing 202, actuate the displacement of the flow control member 224 from the closed position to the open position.

Redundancy is built into the apparatus 200, with the provision of the first and second sensors 3081, 3082, for effecting the displacement of the flow control member 224 from the closed position to the open position (and, in some embodiments, for example, effecting the release of the retention of the flow control member 224 relative to the housing 202). In this respect, in case the reliability of one of the sensors 3081, 3082, for stimulating the actuation system 300 to actuate displacement of the flow control member 224, is compromised, the other one of the sensors 3081, 3082 is available to effect the desired stimulation. Although two sensors 3081, 3082 are illustrated herein, it is understood that more than two sensors may be provided in other embodiments.

Referring to FIG. 25, the first signal sensor 3081 is angularly spaced from the second signal sensor 3082. In those embodiments where the signal sensors 3081, 3082 are extending into the housing passage, by providing this configuration, there is a decreased risk that solid debris (e.g. residual cement), present within the wellbore string passage 106, will interfere with the sensing of an actuation signal that is being transmitted downhole. In some of these embodiments, for example, the angular spacing between the first signal sensor and the second signal sensor 3082 is between about 45 degrees and about 315 degrees, such as, for example, between about 90 degrees and about 270 degrees, such as, for example, between about 135 degrees and about 225 degrees, such as, for example, between about 165 degrees and 195 degrees. In some embodiments, for example, the angular spacing is about 180 degrees. In some embodiments, for example, the first signal sensor 3081 is aligned, or substantially aligned, with the second signal sensor 3082. In other embodiments, for example, the first signal sensor 3081 is axially spaced apart from the second signal sensor 3082.

In some embodiments, for example, each one of the signal sensors 3081, 3082, independently, is disposed for sensing a wirelessly transmitted signal. As above-described, in some embodiments, for example, the wirelessly transmitted signal is a seismic signal. As well, in some embodiments, for example, the wirelessly transmitted signal is a signal transmitted via fluid within the wellbore string passage 106. In this respect, in some embodiments, for example, each one of the signal sensors 3081, 3082, independently, is mounted within the housing 202 and extends into the housing passage 206, such that the signal sensors 3081, 3082 are disposed within the housing passage 206 for sensing wirelessly transmitted signals that are being transmitted through the housing passage 206.

In some embodiments, for example, the transmitted actuation signal is a pressure signal, such as one or more pressure pulses. In some embodiments, for example, the transmitted actuation signal is defined by a pressure pulse characterized by at least a magnitude. In some embodiments, for example, the transmitted signal is defined by a pressure pulse characterized by at least a duration. In some embodiments, for example, the transmitted actuation signal is defined by a pressure pulse characterized by a combination of at least a magnitude and a duration. Different pressure pulse signals may be used to actuate the actuation subsystems 400 or 500, respectively.

In some embodiments, for example, the transmitted actuation signal is defined by a plurality of pressure pulses. In some embodiments, for example, the transmitted actuation signal is defined by a plurality of pressure pulses, each one of the pressure pulses characterized by at least a magnitude. In some embodiments, for example, the transmitted actuation signal is defined by a plurality of pressure pulses, each one of the pressure pulses characterized by at least a magnitude and a duration. In some embodiments, for example, the transmitted actuation signal is defined by a plurality of pressure pulses, each one of the pressure pulses characterized by at least a duration. In some embodiments, for example, each one of pressure pulses is characterized by time intervals between the pulses.

In some embodiments, for example, the transmitted actuation signal is defined by a pressure and hold signal. A pressure and hold signal is a sustained pressure signal. The pressure and hold signal may be defined by a pressure signal that is sustained for a duration of time, which comprise a number of seconds or a number of minutes, for example.

In this respect, in those embodiments where the transmitted signal is a pressure signal being transmitted via fluid within the wellbore string passage 106, in some of these embodiments, for example, each one of the signal sensors 308A, independently, is a pressure sensor. An exemplary pressure sensor is a Kellar Pressure Transducer Model 6LHP/81188™. Other suitable sensors may be employed, depending on the nature of the signal being used for the actuating signal. Other suitable sensors include a Hall effect sensor, a radio frequency identification ("RFID") sensor, or a sensor that can detect a change in chemistry (such as, for example, pH), or radiation levels, or ultrasonic waves.

In some embodiments, for example, the actuation system 300 includes a fluid-communicating passage and a fluid communication controller. The fluid communication controller includes a sealed interface and a sealed interface stimulator. The fluid-communicating passage extends between the housing passage 206 and a fluid pressure responsive surface 226 of the flow control member 224 for effecting fluid communication, between fluid within the housing passage 206 and the fluid pressure responsive surface 226 of the flow control member 224, for urging displacement of the flow control member 224 relative to the subterranean flow communicator 218 (from the closed position to the open position). In some embodiments, for example, the fluid-communicating passage extends through a passage 228 defined within the flow control member 224. In some embodiments, for example, the fluid-communicating passage includes a port that merges with the housing passage 206. The sealed interface is disposed within the fluid-communicating passage. In some embodiments, for example, the sealed interface effects sealing, or substantial sealing, of fluid communication between the housing passage 206 and the fluid pressure responsive surface 226 of the flow control member 224. The sealed interface stimulator is configured for effecting stimulation of the sealed interface, with effect that the sealed interface becomes disposed in a stimulated condition. The sealed interface, the sealed interface stimulator, and the signal sensors 3081, 3082 are co-operatively configured such that, in response to the sensing of the transmitted signal by either one of the signal sensors 3081, 3082, the sealed interface stimulator effects stimulation of the sealed interface. Suitable embodiments of this configuration of actuation system 300 include those of the form of actuation subsystems 1600 and 1700, described above and illustrated in FIGS. 14 and 15 ("cutter puncturing rupture disc" embodiment) and FIGS. 16 and 17 ("exploding bolt" embodiment).

The change in the co-operative disposition between the flow controller 222 and the flow communicator 218, that is actuated by the actuation system 300 in response to a signal that is transmitted from the surface 10 and sensed by the signal sensor configuration 308, is effectuated by a controller (processor) 802 of a control system 800.

Control System and Methods

In this respect, referring to FIG. 19, a control system 800 is illustrated for a flow control apparatus 200 in accordance with one embodiment of the present disclosure. The control system 800 is coupled to the actuation system 300 and comprises a single controller 802 and a single power source 804 (such as, for example a battery). The controller 802 and the power source 804 are connected to both of the actuation subsystems 400, 500 (or 1300, 1400). In some embodiments, for example, the controller 802 is a processor, a circuit board, or a combination thereof. The operation of the controller 802 may be controlled by program software. In other embodiments, for example, each one of the actuation subsystems 400, 500 (or 1300, 1400), independently, includes a respective independent controller and a respective independent power source. Each one of the controllers may function independently of each other. Similarly, each one of the power sources may function independently of each other. In this respect, each subsystem 400, 500 (or 1300, 1400), can be independently powered and independently controlled by respective controllers, or can share a control system with a shared power supply and single controller as shown in FIG. 19. The control system 800 also comprises the signal sensors 308A and orientation sensors 810 of each one of the actuation subsystems 400, 500 (or 1300, 1400). The orientation sensors 810 of the actuation subsystems 400, 500 (or 1300, 1400) are angularly spaced apart, for example, by 180 degrees. In some embodiments, for example, the control system 800 and the signal sensors 308 are powered by a battery that is disposed on-board of the apparatus 200. Passages for wiring for electrically interconnecting the battery, the signal sensors 308, the controller(s), and the sealed interface stimulators 306 are also provided within the apparatus 200.

As described above, the actuation subsystems 400, 500 (or 1300, 1400) may each be carried by a respective separate subassembly and combined to form an integrated assembly or may be built into the same subassembly, depending on the embodiment. For example, two flow control apparatuses 200 may be connected in end-to-end fashion with the actuation subsystems 400, 500 (or 1300, 1400) angularly spaced apart from each other, as described above, to provide "clocked" actuation systems.

Operational Modes

The flow control apparatus 200 may be operated in one of a plurality of operational modes by the use of wirelessly transmitted actuation signals which are received by the signal sensors 308A. The operational mode of the flow control apparatus 200 may also be switched via the wirelessly transmitted actuation signals and/or the controller 802 of the control system 800 of the flow control apparatus 200.

In a first operational mode of the flow control apparatus 200, both actuation subsystems 400, 500 (or 1300, 1400) are activated to provide redundancy. In the first operational mode of the flow control apparatus 200, one or both of the actuation subsystems 400, 500 (or 1300, 1400) are employed to open the subterranean flow communicator 218. This depends on whether, for each one of the actuation subsystems 400, 500 (or 1300, 1400), solid debris (such as residual cement) is interfering with the sensing functionality of the respective sensor 308A, or solid debris (such as residual cement) is blocking fluid-communicating passage 302. If both actuation subsystems 400, 500 (or 1300, 1400) are working correctly, both subsystems will simultaneously, or sequentially, effect fluid communication between the housing passage 206 and the pressure responsive surface 226 to actuate the downhole tool (for example, opening the flow communicator 218). However, if one of the subsystems is not operating correctly, for example due to the presence of cement over the sensor 308A or within the fluid communicating passage 302 of one actuation subsystem, it is likely that the other actuation subsystem will remain functional. In some embodiments, for example, such redundancy may be preferable where accommodation of two power supplies and/or two controllers is prevented by space constraints. In the first operational mode, the signals sensors 308A and orientation sensors 810 may be switched from an active mode (or listening mode) to an inactive mode (or sleep mode) by default to conserve power, for example, battery power.

In a second operational mode of the flow control apparatus 200, one of the actuation subsystems 400, 500 (or 1300, 1400) may be selectively activated in response to data measured by the respective signal sensors 308A. In the second operational mode, the orientation sensors 810 may be switched from an active mode (or listening mode) to an inactive mode (or sleep mode) by default to conserve power, for example, battery power. In some embodiments, for example, one of the actuation subsystems 400, 500 (or 1300, 1400) is selectively activated in response to a determination that only one of the signal sensors 308A is operating normally or that one of the signal sensors 308A has improved performance relative to the other. This determination comprises analysing the measured sensor data, such as pressure data, in accordance with one or more performance criteria. In this respect, in some embodiments, for example, the signal sensors 308A are pressure sensors, as described above. In some embodiments, for example, the performance criteria may be, or comprise, a reference rate of pressure drop. In such embodiments, the wellbore string 104 is pressured with an injection fluid such as, for example, water. The injection fluid is slowly released from the wellbore string 104, for example, by a valve at the well head 108. The pressure of the injection fluid is measured by the pressure sensors and compared to the one or more performance criteria. The performance criteria, such as a reference rate of pressure drop, may be predetermined or may be determined in real-time, for example, by comparing changes in the pressure of the injection fluid measured by the downhole pressure sensors 308A to changes in a pressure of the injection fluid measured by an uphole pressure sensor, for example, at the well head 108. A rate of pressure drop may be determined over a predetermined duration, such as 15, 30 or 60 seconds, for example. The predetermined duration may commence at the same time that the release of the injection fluid commences, for example, when a valve at the well head 108 is opened to release the injection fluid. The reference rate of pressure drop may be an average determined over the predetermined duration. Alternatively, a trend or pattern of the pressure drop may be determined and compared during the evaluation of the criteria rather than a simple rate of pressure drop.

In some embodiments, for example, the actuation subsystems 400, 500 (or 1300, 1400) share a single controller 802, and the controller 802 may be configured to initially process sensor data from the pressures sensors 308A of the actuation subsystems 400, 500 (or 1300, 1400). Where the sensor data is pressure data, the controller 802 may be configured to determine from the measured pressure data whether the actuation subsystems 400, 500 (or 1300, 1400) are operating normally, such as, for example, whether the actuation subsystems 400, 500 (or 1300, 1400) are responding as would be normally expected. This determination may indicate and/or determine whether the actuation subsystems 400, 500 (or 1300, 1400) are reliable, or whether one of the actuation subsystems 400, 500 (or 1300, 1400) is more reliable than the other. When the respective sensor 308A of one of the actuation subsystems 400, 500 (or 1300, 1400) is partially blocked or obstructed by residual cement or other debris, it will typically have a different pressure response, typically a slower rate of pressure drop than if it is not blocked or obstructed. When the respective sensor 308A of one of the actuation subsystems 400, 500 (or 1300, 1400) is completely blocked or obstructed, it will typically measure a different pressure than expected and may have a substantially different pressure response, if any. A sensor 308A of an actuation subsystem 400, 500 (or 1300, 1400) that is partially or completely blocked may be unreliable.

For each one of the actuation subsystems, 400, 500 (or 1300, 1400), the controller 802 may be configured to calculate a rate of pressure drop based on the measured pressure from the respective sensor 308A and determine whether the calculated rate of pressure drop matches a reference rate of pressure drop or other performance criteria. In some embodiments, for example, the calculated rate of pressure drop may be determined to match the one or more criteria when the calculated rate of pressure drop is within a threshold (or tolerance) of the reference rate of pressure drop.

When the calculated rate of pressure drop matches the reference rate of pressure drop or other performance criteria, the respective actuation subsystem 400, 500 (or 1300, 1400) is determined to be operating normally and therefore reliable. When the determined pressure rate drop does not match the reference rate of pressure drop or other performance criteria, the respective actuation subsystems 400, 500 (or 1300, 1400) is determined to be operating abnormally and therefore unreliable. The controller 802 may use this determination to cease monitoring the respective sensor 308A of the actuation subsystem 400, 500 (or 1300, 1400) that is determined to be operating abnormally, i.e. the sensor 308A that is respective to the one of the actuation subsystem 400, 500 (or 1300, 1400) that is more likely to be impeded by residual cement or other debris. The cessation of monitoring of the sensor 308A by the controller 802 may comprise cessation of monitoring a port or contact of the sensor 308A or ignoring the data reported by the sensor 308A. The sensor 308A may also be switched from an active mode (or listening mode) to an inactive mode (known as a sleep mode, off-mode or low power mode) provided by an integrated circuit (IC) of the sensor 308A to conserve power, for example, battery power. In the inactive mode (or sleep mode) of sensor 308A, the sensor 308A does not monitor for wirelessly transmitted actuation signals for activating the actuation subsystems 400, 500 (or 1300, 1400).

Figure 20A:
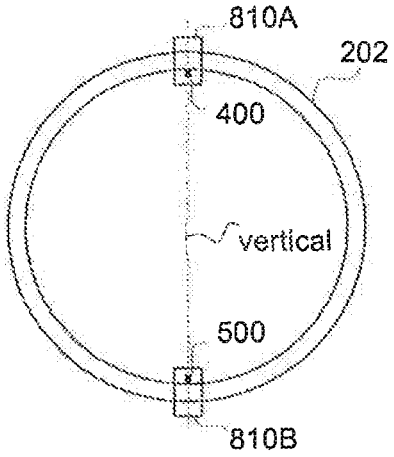
FIGS. 20A and 20B are schematic diagrams of a configuration of orientation sensors of the control system of FIG. 8 in accordance with an example embodiment of the present disclosure.

In a third operational mode of the flow control apparatus 200, one of the actuation subsystems 400, 500 (or 1300, 1400) may be selectively activated in response to data measured by the orientation sensors 810 of the subsystems 400, 500 (or 1300, 1400). In the third operational mode, the signals sensors 308A may be switched from an active mode (or listening mode) to an inactive mode (or sleep mode) by default to conserve power, for example, battery power. In some embodiments, for example, the controller 802 is configured to determine which actuation subsystem 400, 500 (or 1300, 1400) is in a more desirable orientation (for example, which is closest to a reference orientation) using orientation data measured by the orientation sensors 810 and to selectively activate one of the actuation subsystems 400, 500 (or 1300, 1400) in response to the orientation data measured by the orientation sensors 810. Each orientation sensor 810 is aligned with a respective actuation subsystem 400, 500 (or 1300, 1400), and may be used to determine the orientation of the respective actuation subsystem 400, 500 (or 1300, 1400) within the housing 202 of the flow control apparatus 200. In some embodiments, the orientation sensor 810 may comprise one or a combination of a gyroscope, an accelerometer such as a three-axis accelerometer, or other suitable sensor. In example, the orientation sensor 810 is a three-axis accelerometer. Reference is briefly made to FIG. 20A which shows in schematic diagram form a configuration of the orientation sensors 810 of the control system 800 in accordance with an example embodiment of the present disclosure.

Figure 20B:
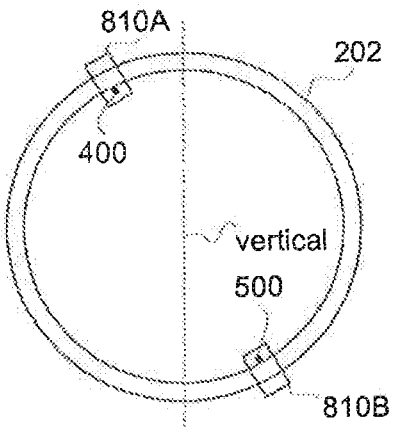

In FIG. 20A, the actuation subsystem 400, 500 (or 1300, 1400) are angularly spaced apart by 180 degrees. In the illustrated example, the actuation subsystem 400 is located at a top of the housing 202 and the actuation subsystem 500 is located at a bottom of the housing 202. It will be appreciated that during installation of the flow control apparatus 200, it is difficult to control the orientation of the flow control apparatus 200 or the actuation subsystems 400, 500 (or 1300, 1400). Accordingly, the actuation subsystems 400, 500 (or 1300, 1400) are typically not vertically aligned as shown in FIG. 20A. Instead, the actuation subsystems 400, 500 (or 1300, 1400) are typically skewed or offset from the vertical as shown in FIG. 20B. Although two actuation subsystem 400, 500 (or 1300, 1400) are shown in FIGS. 20A and 20B, it will be appreciated that more than two actuation subsystems may be provided in other embodiments.

In the third operational mode of the flow control apparatus 200, the controller 802 is configured to receive orientation data from the orientation sensors 810 and determine from the orientation data the orientation of the respective actuation subsystems 400, 500 (or 1300, 1400). The controller 802 may be programmed to determine from the orientation of the actuation subsystems 400, 500 (or 1300, 1400) which actuation subsystem 400 or 500 to use based on which of the actuation subsystems 400, 500 (or 1300, 1400) is more or less likely to be impeded by residual cement. In some embodiments, for example, the controller 802 may be configured to determine which actuation subsystem 400, 500 (or 1300, 1400) is closest to the top of the housing 202 using the orientation data and to select that actuation subsystem 400, 500 (or 1300, 1400) for use, i.e. which sensor 308A to maintain in the active mode (or listening mode) to monitor for wirelessly transmitted actuation signals for activating the actuation subsystems 400, 500 (or 1300, 1400).

A mapping/table of actuation subsystem orientations and the actuation subsystem 400, 500 (or 1300, 1400) to be used for those actuation subsystem orientations may be determined in advance, for example, based on empirical studies.

The mapping/table may be provided to the controller 802, for example by programming, which may determine which actuation subsystem 400, 500 (or 1300, 1400) to use by performing a lookup function on the mapping/table. In some embodiments, for example, the mapping/table may indicate that the actuation subsystem 400, 500 (or 1300, 1400) closest to the top of the housing 202 is in a more desirable orientation and the actuation subsystem 400, 500 (or 1300, 1400) closest to the bottom of the housing 202 is in a less desirable orientation.

The controller 802 may be configured to cease monitoring (or reduce monitoring frequency of) the sensor 308A of the actuation subsystem 400, 500 (or 1300, 1400) that has been determined by data from the orientation sensors 810 to be in a less desirable orientation, i.e. the actuation subsystems 400, 500 (or 1300, 1400) that is more likely to be to be impeded by residual cement. The cessation of monitoring the orientation sensor 810 by the controller 802 may comprise cessation of monitoring a port or contact of the respective orientation sensor 810 or ignoring the data reported by the respective orientation sensor 810. The orientation sensor 810 may also be switched from the active mode (listening mode) to the inactive mode (sleep mode) provided by an IC of the orientation sensor 810 to conserve power, for example, battery power. In the inactive mode of orientation sensor 810, the orientation sensor 810 does not monitor for position data (orientation data). This is optional. In other embodiments, the orientation sensor 810 of the actuation subsystem 400, 500 (or 1300, 1400) that has been determined by data from the orientation sensors 810 to be in the less desirable orientation may be maintained in the active mode. In such embodiments, the controller 802 may be configured to monitor both orientation sensors 810 even though only one of the orientation sensors 810 and one of the actuation subsystem 400, 500 (or 1300, 1400) has been selected for use. This may allow, for example, the controller 802 to switch to the other orientation sensor 810 and the other actuation subsystem 400, 500 (or 1300, 1400), for example, in response to unreliable pressure data being received from the pressure sensor of an actuation subsystem 400, 500 (or 1300, 1400) that was previously selected.

In yet other embodiments, the controller 802 may periodically switch between powering and monitoring each of the orientation sensors 810 during installation/well completion to conserve power, for example, battery power.

The controller 802 may be configured to switch from an initially selected actuation subsystem 400, 500 (or 1300, 1400) to another of the actuation subsystems 400, 500 (or 1300, 1400) that was determined to be in a less desirable orientation in response to detection of one or more conditions such as, for example, unreliable pressure data being received from the pressure sensor of the actuation subsystem 400, 500 (or 1300, 1400) that was initially selected. The measured pressure data may be determined to be unreliable when the measured pressure data does not match one or more subsequent performance criteria which may comprise pressure spikes, abnormally high levels of variability or other factors.

The controller 802 may be configured to alternate between monitoring and processing data from the actuation subsystems 400, 500 (or 1300, 1400), for example, in response to unreliable pressure data being received from the pressure sensor of an actuation subsystem 400, 500 (or 1300, 1400) that was previously selected.

The orientation sensors 810 may also be configured to draw power from the power source 804 and communicate with the controller 802 for a threshold duration of time, for example during installation/well completion to conserve power, for example, battery power. The orientation sensors 810 may be switched from the active mode (or listening mode) to the inactive mode (or sleep mode) provided by the IC of the orientation sensors 810 after the threshold duration of time, as noted above.

In a fourth operational mode of the flow control apparatus 200, one of the actuation subsystems 400, 500 (or 1300, 1400) may be selectively activated in response to data measured by the respective signal sensors 308A or in response to data measured by the orientation sensors 810 of the subsystems 400, 500 (or 1300, 1400). For example, if the measured pressure from both sensors 308A indicated that neither sensor 308A is operating normally, the orientation sensors 810 may be used by the control system 800 to determine the orientation of the actuation subsystems 400, 500 (or 1300, 1400). The signal sensors 308A may be switched to the inactive mode (or sleep mode). If the orientation data measured by the orientation sensors 810 indicates that neither of the actuation subsystems 400, 500 (or 1300, 1400) is in a desirable orientation for use, for example by comparison to a reference orientation, the controller 802 may be determine which of the actuation subsystems 400, 500 (or 1300, 1400) to use, or both, by determining which actuation subsystems 400, 500 (or 1300, 1400) has a higher reliability. Reliability may be determined by analyzing both the measured pressure data and orientation data and comparing the measured pressure data and orientation data to one or more references. For example, if neither pressure sensor is operating normally and neither actuation subsystems 400, 500 (or 1300, 1400) is in a desirable orientation for use, the controller 802 switches the sensors 308A to the active mode (or listening mode) if the sensors 308A were switched to the inactive mode and determines which actuation subsystems 400, 500 (or 1300, 1400) to actuate, or both, based on both the pressure data and orientation data, for example, by determining which of the actuation subsystems 400, 500 (or 1300, 1400) has pressure data closest to performance criteria and orientation data closest to a reference orientation. If the pressure data and orientation data are not within a threshold of the performance criteria and reference orientation, respectively, the controller 802 may determine to actuate both actuation subsystems 400, 500 (or 1300, 1400). Although consideration of the pressure data occurs before the consideration of orientation data in the foregoing description, the order of consideration of the pressure data and orientation data may be reversed in other embodiments.

The controller 802 may use pressure data and orientation data to determine which of the sensors 308A or orientation sensors 810, if any, to switch from an active mode (or listening mode) to an inactive mode based on the reliability of the data, as described above.

Figure 21:
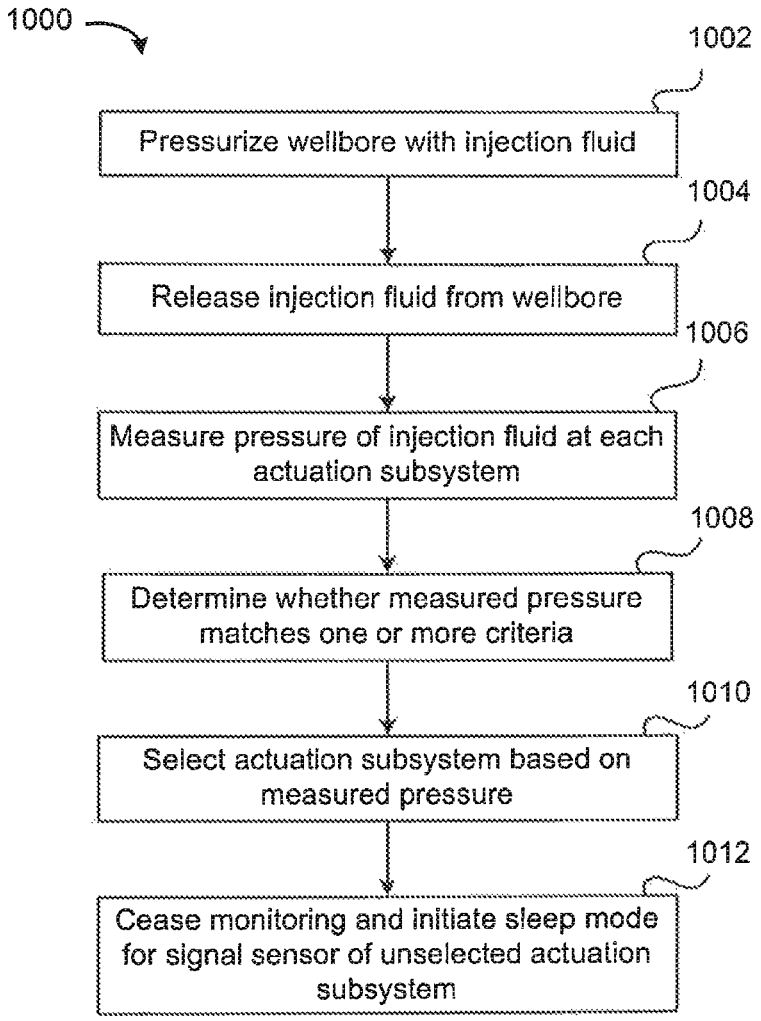
FIG. 21 is a flowchart of a method of operating a flow control apparatus in accordance with an example embodiment of the present disclosure.

Referring now to FIG. 21, a method 1000 of operating a flow control apparatus 200 in accordance with an example embodiment of the present disclosure will be described. At least parts of the method 1000 are carried out by the controller 802 of the control system 800. At operation 1002, the wellbore 104 is pressurized with an injection fluid such as water.

At operation 1004, the injection fluid is released from the wellbore 104.

At operation 1006, while the injection fluid is being released from the wellbore 104, a pressure of the injection fluid is measured by a respective sensor 308A of each one of the actuation subsystems 400, 500 (or 1300, 1400).

At operation 1008, the measured pressure of each sensor 308A is compared to one or more performance criteria to determine whether the sensor 308A is operating normally. For example, a rate of pressure drop may be calculated and compared to a reference rate of pressure drop. In some embodiments, for example, when the calculated rate of pressure drop is within a threshold of the reference rate of pressure drop, the sensor 308A is determined to be operating normally. When the calculated rate of pressure drop is outside of the threshold of the reference rate of pressure drop, the sensor 308A is determined to be operating abnormally.

At operation 1010, one of the actuation subsystems 400, 500 (or 1300, 1400) may be selected and actuated in response to the measured pressure. In some embodiments, for example, the one of the actuation subsystems 400, 500 (or 1300, 1400) having a sensor 308A that is determined to be operating normally is selected for use and maintained in the active mode (or listening mode). The controller 802 ceases monitoring the sensor 308A of the one of the actuation subsystems 400, 500 (or 1300, 1400) that is determined to be operating abnormally. In some embodiments, when both actuation subsystems 400, 500 (or 1300, 1400) are determined to have a respective sensor 308A that is operating normally, the actuation subsystem 400, 500 (or 1300, 1400) having a sensor 308A for which the calculated rate of pressure drop is closest to the reference rate of pressure drop is selected for use and maintained in the active mode (or listening mode). The controller 802 ceases monitoring the sensor 308A of the actuation subsystems 400, 500 (or 1300, 1400) for which the calculated rate of pressure drop is not closest to the reference rate of pressure drop is selected for use and maintained in the active mode (or listening mode). The selection of the actuation subsystems 400, 500 (or 1300, 1400) to be used may be performed when initial attempting to open the flow control apparatus 200, in response to problems in opening the flow control apparatus 200, or other suitable time.

At operation 1012, the sensor 308A of each actuation subsystems 400, 500 (or 1300, 1400) which is not selected is switched from the listening mode (or active mode) to the sleep mode (or inactive mode). The sensor 308A may be switched back from the sleep mode (or inactive mode) to the listening mode (or active mode) by the controller 802 in response to detecting one or more conditions, such as, for example, unreliable pressure data being received from the pressure sensor of the actuation subsystem 400, 500 (or 1300, 1400) that was initially selected.

Figure 22:
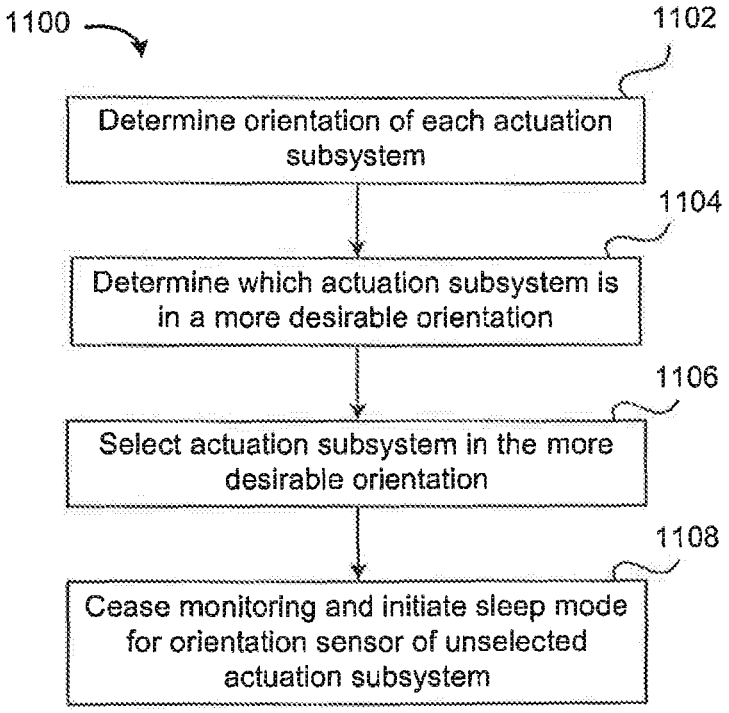
FIG. 22 is a flowchart of a method of operating a flow control apparatus in accordance with another example embodiment of the present disclosure.

Referring now to FIG. 22, a method 1100 of operating a flow control apparatus 200 in accordance with another example embodiment of the present disclosure will be described. At least parts of the method 1100 are carried out by the controller 802 of the control system 800.

At operation 1102, an orientation of each of the actuation subsystems 400, 500 (or 1300, 1400) is determined via orientation sensors 810, such as an accelerometer.

At operation 1104, the controller 802 determines which of the actuation subsystems 400, 500 (or 1300, 1400) is in a more desirable by orientation by comparing the orientation of each of the actuation subsystems 400, 500 (or 1300, 1400) to one or more reference orientations.

At operation 1106, the controller 802 selects and actuates the actuation subsystems 400, 500 (or 1300, 1400) that is in a more desirable orientation, for example, the actuation subsystems 400, 500 (or 1300, 1400) that is closest to a reference orientation. In some examples, the reference orientation may be a top of the housing of the flow control apparatus 200.

At operation 1108, the orientation sensors 810 of the actuation subsystem 400, 500 (or 1300, 1400) which are not selected, are switched from the listening mode (or active mode) to the sleep mode (or inactive mode). The orientation sensor 810 may be switched back from the sleep mode (or inactive mode) to the listening mode (or active mode) by the controller 802 in response to detecting one or more conditions, such as, for example, unreliable pressure data being received from the pressure sensor of the actuation subsystem 400, 500 (or 1300, 1400) that was initially selected.

Figure 23:
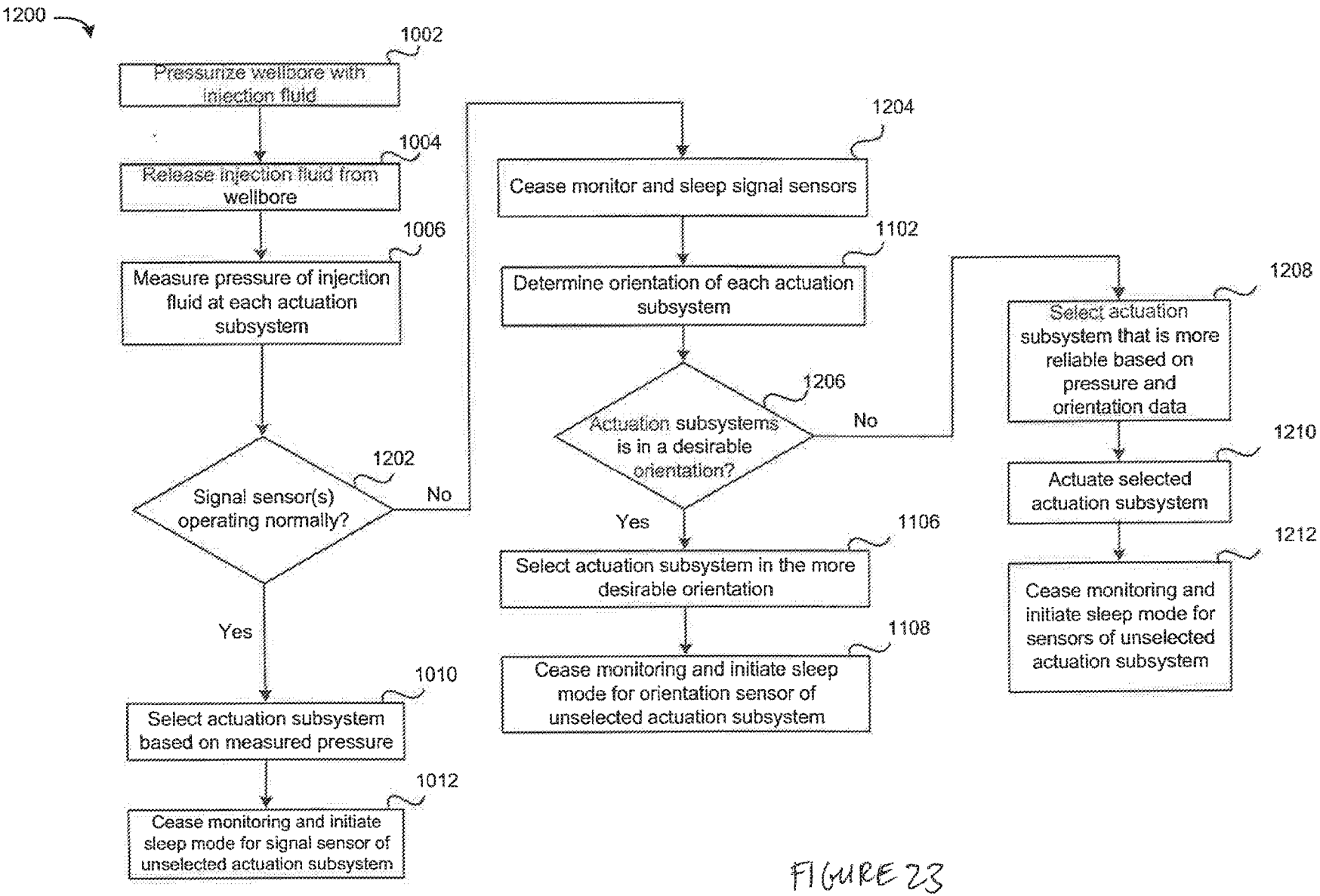
FIG. 23 is a flowchart of a method of operating a flow control apparatus in accordance with a further example embodiment of the present disclosure.

Referring now to FIG. 23, a method 1200 of operating a flow control apparatus 200 in accordance with an example embodiment of the present disclosure will be described. At least parts of the method 1200 are carried out by the controller 802 of the control system 800. At operation 1002, the wellbore 104 is pressurized with an injection fluid such as water. The method 1200 combines elements of method 1000 of FIG. 21 and method 11000 of FIG. 22, described above.

At operation 1004, the injection fluid is released from the wellbore 104.

At operation 1006, while the injection fluid is being released from the wellbore 104, a pressure of the injection fluid is measured by a respective sensor 308A of each one of the actuation subsystems 400, 500 (or 1300, 1400).

At operation 1202, the measured pressure of each sensor 308A is compared to one or more performance criteria to determine whether at least one of the sensors 308A is operating normally. The performance criteria may be a rate of pressure drop may be calculated and compared to a reference rate of pressure drop, as described above.

In response to a determination that at least one of the sensors 308A is operating normally, processing proceeds to operations 1010-1012 as described above in connection with FIG. 21. In response to a determination that neither of the sensors 308A is operating normally, processing proceeds to operation 1204 in which the controller 802 optionally ceases monitoring the sensors 308A and optionally switches the sensors 308A from the listening mode (or active mode) to the sleep mode (or inactive mode). Next, in operation 1102, an orientation of each of the actuation subsystems 400, 500 (or 1300, 1400) is determined via orientation sensors 810, such as an accelerometer.

Next, at operation 1206, the controller 802 determines whether at least one of the actuation subsystems 400, 500 (or 1300, 1400) is in a desirable orientation by comparing the orientation of each of the actuation subsystems 400, 500 (or 1300, 1400) to one or more reference orientations. In response to a determination that at least one of the actuation subsystems 400, 500 (or 1300, 1400) is in a desirable orientation, processing proceeds to operations 1106-1108 as described above in connection with FIG. 22.

In response to a determination that neither of the actuation subsystems 400, 500 (or 1300, 1400) is in a desirable orientation, the controller 802 selects one or more of the actuation subsystems 400, 500 (or 1300, 1400) to actuate (operation 1208) based on both the pressure data and orientation data. This determination may be made by determining which of the actuation subsystems 400, 500 (or 1300, 1400) has a higher reliability. Reliability may be determined by analyzing both the measured pressure data and orientation data and comparing the measured pressure data and orientation data to one or more references, as described above. This comprises switching the sensors 308A to the active mode (or listening mode) if the sensors 308A were previously switched to the inactive mode and recommencing listening to the sensors 308A if the controller 802 previously ceased monitoring the sensors 308A.

In some examples, the controller 802 may first determine whether the pressure data and/or orientation data are within a threshold of the performance criteria and reference orientation. When the pressure data and/or orientation data are within the threshold of the performance criteria and reference orientation, the controller 802 may select the actuation subsystems 400, 500 (or 1300, 1400) for which measured pressure data is closest to the performance criteria or for which the measured orientation data is closest to the reference orientation, depending on the embodiment. This actuation subsystem 400, 500 (or 1300, 1400) for which measured pressure data is closest to the performance criteria or for which the measured orientation data is closest to the reference orientation is considered to have a higher reliability. In some examples, if the pressure data and/or orientation data are not within the threshold of the performance criteria and reference orientation, respectively, the controller 802 may determine to actuate both actuation subsystems 400, 500 (or 1300, 1400).

At operation 1210, the selected actuation subsystem 400, 500 (or 1300, 1400) is actuated, i.e. the actuation subsystem 400, 500 (or 1300, 1400) having the higher reliability, is actuated.

At operation 1212, the controller 802 may optionally use pressure data and orientation data to determine which of the sensors 308A or orientation sensors 810, if any, to cease monitoring and optionally switch from an active mode (or listening mode) to an inactive mode based on the reliability of the data, as described above.

The steps and/or operations in the flowcharts and drawings described herein are for purposes of example only. There may be many variations to these steps and/or operations without departing from the teachings of the present disclosure. For instance, the steps may be performed in a differing order, or steps may be added, deleted, or modified.

The coding of software for carrying out the above-described methods described is within the scope of a person of ordinary skill in the art having regard to the present disclosure. Machine-readable code executable by one or more processors of one or more respective devices to perform the above-described method may be stored in a machine-readable medium such as the memory of the data manager. The terms "software" and "firmware" are interchangeable within the present disclosure and comprise any computer program stored in memory for execution by a processor, comprising Random Access Memory (RAM) memory, Read Only Memory (ROM) memory, EPROM memory, electrically EPROM (EEPROM) memory, and non-volatile RAM (NVRAM) memory. The above memory types are examples only, and are thus not limiting as to the types of memory usable for storage of a computer program.

All values and sub-ranges within disclosed ranges are also disclosed. Also, although the systems, devices and processes disclosed and shown herein may comprise a specific plurality of elements, the systems, devices and assemblies may be modified to comprise additional or fewer of such elements. Although several example embodiments are described herein, modifications, adaptations, and other implementations are possible. For example, substitutions, additions, or modifications may be made to the elements illustrated in the drawings, and the example methods described herein may be modified by substituting, reordering, or adding steps to the disclosed methods. In addition, numerous specific details are set forth to provide a thorough understanding of the example embodiments described herein. It will, however, be understood by those of ordinary skill in the art that the example embodiments described herein may be practiced without these specific details. Furthermore, well-known methods, procedures, and elements have not been described in detail so as not to obscure the example embodiments described herein. The subject matter described herein intends to cover and embrace all suitable changes in technology.

Although the present disclosure is described at least in part in terms of methods, a person of ordinary skill in the art will understand that the present disclosure is also directed to the various elements for performing at least some of the aspects and features of the described methods, be it by way of hardware, software or a combination thereof. Accordingly, the technical solution of the present disclosure may be embodied in a non-volatile or non-transitory machine-readable medium (e.g., optical disk, flash memory, etc.) having stored thereon executable instructions tangibly stored thereon that enable a processing device to execute examples of the methods disclosed herein.

The term "processor" may comprise any programmable system comprising systems using microprocessors/controllers or nanoprocessors/controllers, digital signal processors (DSPs), application specific integrated circuits (ASICs), field-programmable gate arrays (FPGAs) reduced instruction set circuits (RISCs), logic circuits, and any other circuit or processor capable of executing the functions described herein. The term "database" may refer to either a body of data, a relational database management system (RDBMS), or to both. As used herein, a database may comprise any collection of data comprising hierarchical databases, relational databases, flat file databases, object-relational databases, object oriented databases, and any other structured collection of records or data that is stored in a computer system. The above examples are example only, and thus are not intended to limit in any way the definition and/or meaning of the terms "processor" or "database".

The present disclosure may be embodied in other specific forms without departing from the subject matter of the claims. The described example embodiments are to be considered in all respects as being only illustrative and not restrictive. The present disclosure intends to cover and embrace all suitable changes in technology. The scope of the present disclosure is, therefore, described by the appended claims rather than by the foregoing description. The scope of the claims should not be limited by the embodiments set forth in the examples, but should be given the broadest interpretation consistent with the description as a whole.

The invention claimed is:

1. An apparatus for disposition within a wellbore comprising:

a downhole tool;

an actuation system;

a first pressure sensor disposed for sensing a wirelessly transmitted signal, and coupled to the actuation system such that, in response to the sensing of the transmitted signal by the first pressure sensor, the actuation system actuates operation of the downhole tool; and a second pressure sensor disposed for sensing the wirelessly transmitted signal, and coupled to the actuation system such that, in response to the sensing of the transmitted signal by the second pressure sensor, the actuation system actuates operation of the downhole tool;

wherein, relative to the central longitudinal axis of the housing passage, the first pressure sensor is angularly spaced from the second pressure sensor.

2. The apparatus as claimed in claim 1;

wherein:

the first pressure sensor is disposed in communication with a housing passage for sensing a wirelessly transmitted signal that is transmitted through the housing passage; and the second pressure sensor is disposed in communication with the housing passage for sensing a wirelessly transmitted signal that is transmitted through the housing passage.

3. The apparatus as claimed in claim 1;

wherein the angular spacing between the first pressure sensor and the second pressure sensor is between about 45 degrees and about 315 degrees.

4. The apparatus as claimed in claim 1;

wherein:

the downhole tool includes a flow controller;

the operation of the downhole tool includes an opening of the flow controller.

5. The apparatus as claimed in claim 4;

wherein:

the downhole tool further includes:

a housing;

a housing passage disposed within the housing; and a flow communicator for effecting flow communication between a subterranean formation and the housing passage;

the flow communicator and the flow controller co-operatively configured for disposition in a closed configuration, wherein, in the closed configuration, the flow communicator is disposed in a closed condition;

the operation of the downhole tool, which is actuatable by the actuation system in response to the sensing of the transmitted signal by the first pressure sensor, includes a change in the co-operative disposition between the flow communicator and the flow controller, with effect that there is a change in the condition of the flow communicator from the closed condition to an open condition; and the operation of the downhole tool, which is actuatable by the actuation system in response to the sensing of the transmitted signal by the second pressure sensor, includes a change in the co-operative disposition between the flow communicator and the flow controller, with effect that there is a change in the condition of the flow communicator from the closed condition to an open condition.

6. The flow control apparatus as claimed in claim 5;

wherein:

the flow controller includes a first flow control member and a second flow control member;

the change in the co-operative disposition between the flow communicator and the flow controller, actuated in response to the sensing of the transmitted signal by the first pressure sensor, with effect that there is a change in the condition of the flow communicator from the closed condition to an open condition, includes a displacement of the first flow control member relative to the flow communicator; and the change in the co-operative disposition between the flow communicator and the flow controller, actuated in response to the sensing of the transmitted signal by the second pressure sensor, with effect that there is a change in the condition of the flow communicator from the closed condition to an open condition, includes a displacement of the second flow control member relative to the flow communicator.

7. The apparatus as claimed in claim 6;

wherein:

the flow communicator includes a first port and a second port;

the first port is respective to the first flow control member, such that the change in condition of the flow communicator, responsive to the displacement of the first flow control member relative to the flow communicator, is a change in condition of the first port from a closed condition to an open condition; and the second port is respective to the second flow control member, such that the change in condition of the flow communicator, responsive to the displacement of the second flow control member relative to the flow communicator, is a change in condition of the second port from a closed condition to an open condition.

8. The apparatus as claimed in claim 1;

wherein:

the actuation system includes a first actuation subsystem and a second actuation subsystem;

the coupling of the first pressure sensor to the actuation system includes a coupling of the first pressure sensor to the first actuation subsystem, and the coupling of the first pressure sensor to the first actuation subsystem is such that, in response to the sensing of the transmitted signal by the first pressure sensor, the first actuation subsystem actuates the operation of the downhole tool; and the coupling of the second pressure sensor to the actuation system includes a coupling of the second pressure sensor to the second actuation subsystem, and the coupling of the second pressure sensor to the second actuation subsystem is such that, in response to the sensing of the transmitted signal by the second pressure sensor, the second actuation subsystem actuates the operation of the downhole tool.

9. The apparatus as claimed in claim 8;

wherein, relative to the central longitudinal axis of the housing passage, the first actuation subsystem is angularly spaced from the second actuation subsystem.

10. The apparatus as claimed in claim 9;

wherein the angular spacing between the first actuating subsystem and the second actuating subsystem is between about 45 degrees and about 315 degrees.

11. An apparatus, cemented within a wellbore, comprising:

a fluid supply conductor;

a downhole tool;

a first actuation system including:

a first fluid-communicating passage for effecting fluid communication between the fluid supply conductor and the downhole tool, wherein the first fluid communication passage includes a first communication port that merges with the actuating fluid supply conductor;

a first sealed interface disposed within the first fluid-communicating passage; and a first sealed interface stimulator configured for effecting application of a stimulus to the first sealed interface in response to receiving of a predetermined signal;

wherein:

the first sealed interface and the first sealed interface stimulator are co-operatively configured such that, in response to the receiving of the predetermined signal by the first sealed interface stimulator, the first sealed interface stimulator effects application of a stimulus to the first sealed interface, with effect that the first sealed interface becomes defeated, with effect that fluid communication, via the first fluid-communicating passage, is established between the fluid supply conductor and the downhole tool, with effect that, while pressurize fluid is emplaced within the fluid supply conductor, the operation of the downhole tool is actuated;

a second actuation system including:

a second fluid-communicating passage for effecting fluid communication between the actuating fluid supply conductor and the downhole tool, for actuating the operation of the downhole tool, wherein the second fluid communication passage includes a second communication port that merges with the actuating fluid supply conductor;

a second sealed interface disposed within the second fluid-communicating passage; and a second sealed interface stimulator configured for effecting application of a stimulus to the second sealed interface in response to receiving of a predetermined signal;

wherein:

the second sealed interface and the second sealed interface stimulator are co-operatively configured such that, in response to the receiving of the predetermined signal by the second sealed interface stimulator, the second sealed interface stimulator effecting application of a stimulus to the second sealed interface, with effect that the second sealed interface becomes defeated, with effect that fluid communication, via the second fluid-communicating passage, is established between the fluid supply conductor and the downhole tool, with effect that, while pressurize fluid is emplaced within the fluid supply conductor, operation of the downhole tool is actuated; and relative to the central longitudinal axis of the apparatus, the first communication port of the first actuation system is angularly spaced from the second communication port of the second actuation system.

12. The apparatus as claimed in claim 11;

wherein:

the downhole tool includes a valve;

the operation of the downhole tool, which the first actuation system is configured to actuate, includes an opening of the valve; and the operation of the downhole tool, which the second actuation system is configured to actuate, includes an opening of the valve.

13. The apparatus as claimed in claim 11;

wherein:

the downhole tool includes:

a housing;

a housing passage, defined by the fluid supply conductor, disposed within the housing;

a flow communicator for effecting flow communication between the subterranean formation and the housing passage; and a flow controller;

the flow communicator and the flow controller are co-operatively configured for disposition in a closed configuration, wherein, in the closed configuration, the flow communicator is disposed in a closed condition;

the operation of the downhole tool, which the first actuation system is configured to actuate, includes a change in the co-operative disposition between the flow communicator and the flow controller, with effect that there is a change in the condition of the flow communicator from the closed condition to an open condition; and the operation of the downhole tool, which the second actuation system is configured to actuate, includes a change in the co-operative disposition between the flow communicator and the flow controller, with effect that there is a change in the condition of the flow communicator from the closed condition to an open condition.

14. The apparatus as claimed in claim 13;

wherein:

the flow controller includes a flow control member that is displaceable relative to the flow communicator; and the change in the co-operative disposition between the flow communicator and the flow controller, which the first actuation system is configured to actuate, with effect that there is a change in the condition of the flow communicator from the closed condition to an open condition, includes a displacement of the flow control member relative to the flow communicator; and the change in the co-operative disposition between the flow communicator and the flow controller, which the second actuation system is configured to actuate, with effect that there is a change in the condition of the flow communicator from the closed condition to an open condition, includes a displacement of the flow control member relative to the flow communicator.

15. The flow control apparatus as claimed in claim 13;

wherein:

the flow controller includes a first flow control member and a second flow control member;

the change in the co-operative disposition between the flow communicator and the flow controller, which the first actuation system is configured to actuate, with effect that there is a change in the condition of the flow communicator from the closed condition to an open condition, includes a displacement of the first flow control member relative to the flow communicator; and the change in the co-operative disposition between the flow communicator and the flow controller, which the second actuation system is configured to actuate, with effect that there is a change in the condition of the flow communicator from the closed condition to an open condition, includes a displacement of the first flow control member relative to the flow communicator.

16. The apparatus as claimed in claim 11;

wherein the angular spacing between the first actuation system and the second actuation system is between about 45 degrees and about 315 degrees.

17. An apparatus for disposition within a wellbore comprising:

a housing;

a controller;

an actuation system disposed within the housing comprising at least a first actuation subsystem and a second actuation subsystem;

a first orientation sensor positioned within the housing and aligned with the first actuation subsystem, and configured to determine an orientation of the first actuation subsystem; and a second orientation sensor positioned within the housing and aligned with the second actuation subsystem, and configured to determine an orientation of the second actuation subsystem;

wherein the controller is configured to:

determine which one of the first actuation subsystem or second actuation subsystem is disposed in a more desirable orientation by comparing an orientation of each one of the first actuation subsystem and second actuation subsystem to one or more reference positions;

activating the one of the first and second actuation subsystems disposed in a more desirable orientation; and maintaining the other one of the first and second actuation subsystems in an inactive mode.

18. The apparatus as claimed in claim 17;

wherein each one of the first orientation sensor and second orientation sensor, independently, comprises an accelerometer.

19. The apparatus as claimed in claim 17;

further comprising:

a first actuation system-triggering sensor configured for receiving a signal being transmitted via fluid within the housing passage; and a second actuation system-triggering sensor configured for receiving the signal being transmitted via fluid within the housing passage;

wherein:

the first actuation subsystem is responsive to the first actuation system-triggering sensor; and the second actuation subsystem is responsive to the second actuation system-triggering sensor.

20. The apparatus as claimed in claim 19;

wherein the controller is configured to maintain the first actuation system-triggering sensor or the second actuation system-triggering sensor in a listening mode for monitoring for the signal transmitted via fluid within the wellbore for activating the respective first actuation subsystem or second actuation subsystem in dependence on which of the first actuation subsystem or the second actuation subsystem is in the more desirable orientation.

* * * * *